US007449843B2

(12) United States Patent
Hsueh et al.

(10) Patent No.: US 7,449,843 B2
(45) Date of Patent: Nov. 11, 2008

(54) TRANSFORMER FOR DRIVING MULTI-LAMP AND BACKLIGHT MODULE THEREOF

(75) Inventors: Ching-Fu Hsueh, Bade (TW); Cheng-Hsien Chien, Taoyuan (TW); Wan-Chin Hsu, Dasi Township, Taoyuan County (TW)

(73) Assignee: Darfon Electronics Corp., Taoyuan (TW)

( * ) Notice: Subject to any disclaimer, the term of this patent is extended or adjusted under 35 U.S.C. 154(b) by 0 days.

(21) Appl. No.: 11/828,545

(22) Filed: Jul. 26, 2007

(65) Prior Publication Data

US 2008/0048580 A1 Feb. 28, 2008

(30) Foreign Application Priority Data

Jul. 27, 2006 (TW) ..... 95127560 A

(51) Int. Cl.
*H05B 41/16* (2006.01)

(52) U.S. Cl. ..... 315/281; 315/282; 315/278; 315/324; 336/213; 336/221; 336/222; 29/606; 29/607; 345/102

(58) Field of Classification Search ..... 315/276–278, 315/281, 282, 291, 312, 324; 336/172, 173, 336/178, 212, 213, 180, 220–222; 29/605–607; 345/87, 102; 323/305, 308
See application file for complete search history.

(56) References Cited

U.S. PATENT DOCUMENTS

| | | | | |
|---|---|---|---|---|
| 2,802,981 | A * | 8/1957 | Blankenbuehler et al. | 323/250 |
| 5,905,646 | A * | 5/1999 | Crewson et al. | 363/132 |
| 6,256,865 | B1 * | 7/2001 | Larranaga et al. | 29/605 |
| 6,348,848 | B1 * | 2/2002 | Herbert | 336/178 |
| 7,282,868 | B2 * | 10/2007 | Ushijima et al. | 315/277 |
| 2004/0155596 | A1 | 8/2004 | Ushijima et al. | |
| 2008/0143276 | A1 * | 6/2008 | Hsueh et al. | 315/324 |

* cited by examiner

*Primary Examiner*—Haissa Philogene
(74) *Attorney, Agent, or Firm*—Thomas, Kayden, Horstemeyer & Risley

(57) ABSTRACT

A transformer for driving multi-lamps and a backlight module thereof are provided. The transformer comprises a primary winding, a secondary winding, a core, a first bobbin and a second bobbin. The primary winding comprises a primary coil. The secondary winding comprises a secondary coil and a plurality of auxiliary coils whose turns are substantially equal. The core has a first side and a second side. The first bobbin and the second bobbin are respectively disposed on the first side and the second side for winding around the primary coil, the secondary coil and the auxiliary coils.

40 Claims, 37 Drawing Sheets

TRANSFORMER FOR DRIVING MULTI-LAMP AND BACKLIGHT MODULE THEREOF

This application claims the benefit of Taiwan application Serial No. 95127560, filed Jul. 27, 2006, the subject matter of which is incorporated herein by reference.

BACKGROUND OF THE INVENTION

1. Field of the Invention

The invention relates in general to a transformer and a backlight module thereof, and more particularly to a transformer for driving multi-lamps and a backlight module thereof.

2. Description of the Related Art

As the size of liquid crystal display (LCD) increases, the luminance provided by the backlight of the LCD must increase accordingly so as to main the display quality of an image. In order to increase the luminance of the backlight module, multiple lamps are used.

Referring to FIG. 1, a perspective of a conventional backlight module is shown. The conventional backlight module 10 comprises a driving circuit 110, a conventional transformer 120, and two lamps 130(1)~130(2). The primary coil of the conventional transformer 120 is coupled to the driving circuit 110, and the secondary coil of the conventional transformer is coupled to the lamps 130(1)~130(2).

However, as the currents I1 and I2 flowing through the lamps 130(1)~130(2) are different from each other due to the characteristics of the lamp 130(1) and the lamp 130(2), the luminance generated by the lamp 130(1) is thus different from that generated by the lamp 130(2). As a result, the display quality of LCD is affected and deteriorates. Besides, when the currents I1 and I2 are unbalanced, the lifespan of the lamps will be shortened. Therefore, how to resolve the problem of unbalanced currents when driving multi-lamps has become an imminent issue to be resolved in the LCD industry.

SUMMARY OF THE INVENTION

The invention is directed to a transformer for driving multi-lamps and a backlight module thereof. As the transformer has several auxiliary coils whose turns are substantially equal, the currents flowing through the lamps are also substantially equal. Besides, as the primary coil, the secondary coil and the auxiliary coils can be selectively disposed on the first bobbin and the second bobbin at the two sides of the core according to the needs of the design, the transformer has an even smaller volume and a thinner size.

According to a first aspect of the present invention, a transformer for driving multi-lamps is provided. The transformer comprises a primary winding, a secondary winding, a core, a first bobbin and a second bobbin. The primary winding comprises a primary coil. The secondary winding comprises a secondary coil and a plurality of auxiliary coils whose turns are substantially equal. The core has a first side and a second side. The first bobbin and the second bobbin are respectively disposed on the first side and the second side for winding around the primary coil, the secondary coil and the auxiliary coils.

According to a second aspect of the present invention, a backlight module comprising a plurality of lamps, a driving circuit and a transformer is provided. The transformer comprises a primary winding, a secondary winding, a core, a first bobbin and a second bobbin. The primary winding comprises a primary coil. The secondary winding comprises a secondary coil and a plurality of auxiliary coils whose turns are substantially equal.

The primary coil is coupled to the driving circuit. The lamps are coupled to the secondary coil respectively through the auxiliary coils. The core has a first side and a second side. The first bobbin and the second bobbin are respectively disposed on the first side and the second side for winding around the primary coil, the secondary coil and the auxiliary coils.

As the winding turns of the auxiliary coils are substantially equal, the currents flowing through the lamps are also substantially equal.

According to a third aspect of the present invention, a backlight module. The backlight module comprises a plurality of lamps, a driving circuit and a transformer. The transformer comprises a primary winding, a secondary winding, a core, a first bobbin and a second bobbin. The primary winding comprises a primary coil. The secondary winding comprises a secondary coil and a plurality of auxiliary coils whose turns are substantially equal.

The primary coil is coupled to the driving circuit. The auxiliary coils are coupled to the secondary coil respectively through lamp. The core has a first side and a second side. The first bobbin and the second bobbin are respectively disposed on the first side and the second side for winding around the primary coil, the secondary coil and the auxiliary coils.

As the winding turns of the auxiliary coils are substantially equal, the currents flowing through the lamps are also substantially equal.

According to a fourth aspect of the present invention, a backlight module. comprising a plurality of lamps, a driving circuit and a transformer is provided. The transformer comprises a primary winding, a secondary winding, a core, a first bobbin and a second bobbin. The primary winding comprises a primary coil. The secondary winding comprises a secondary coil and a plurality of auxiliary coils whose turns are substantially equal.

The primary coil is coupled to the driving circuit. The two ends of each lamp are respectively coupled to corresponding auxiliary coils, which are coupled to the secondary coil respectively through the lamp. The core has a first side and a second side. The first bobbin and the second bobbin are respectively disposed on the first side and the second side for winding around the primary coil, the secondary coil and the auxiliary coils.

As the winding turns of the auxiliary coils are substantially equal, the currents flowing through the lamps are also substantially equal.

The invention will become apparent from the following detailed description of the preferred but non-limiting embodiments. The following description is made with reference to the accompanying drawings.

DETAILED DESCRIPTION OF THE INVENTION

In order to make the currents flowing through the lamps of the backlight module substantially equal, the transformer disclosed in the embodiments below uses several auxiliary coils whose turns are substantially equal to balance the currents flowing through the lamps, hence prolonging the lifespan of the lamps and improving the display quality of the liquid crystal display (LCD).

Besides, in the transformer, the primary coil, the secondary coil and the auxiliary coils can selectively wind around the first bobbin or the second bobbin disposed at the two sides of the core, therefore the volume and the size of the transformer are made even smaller and thinner.

Figure 1:
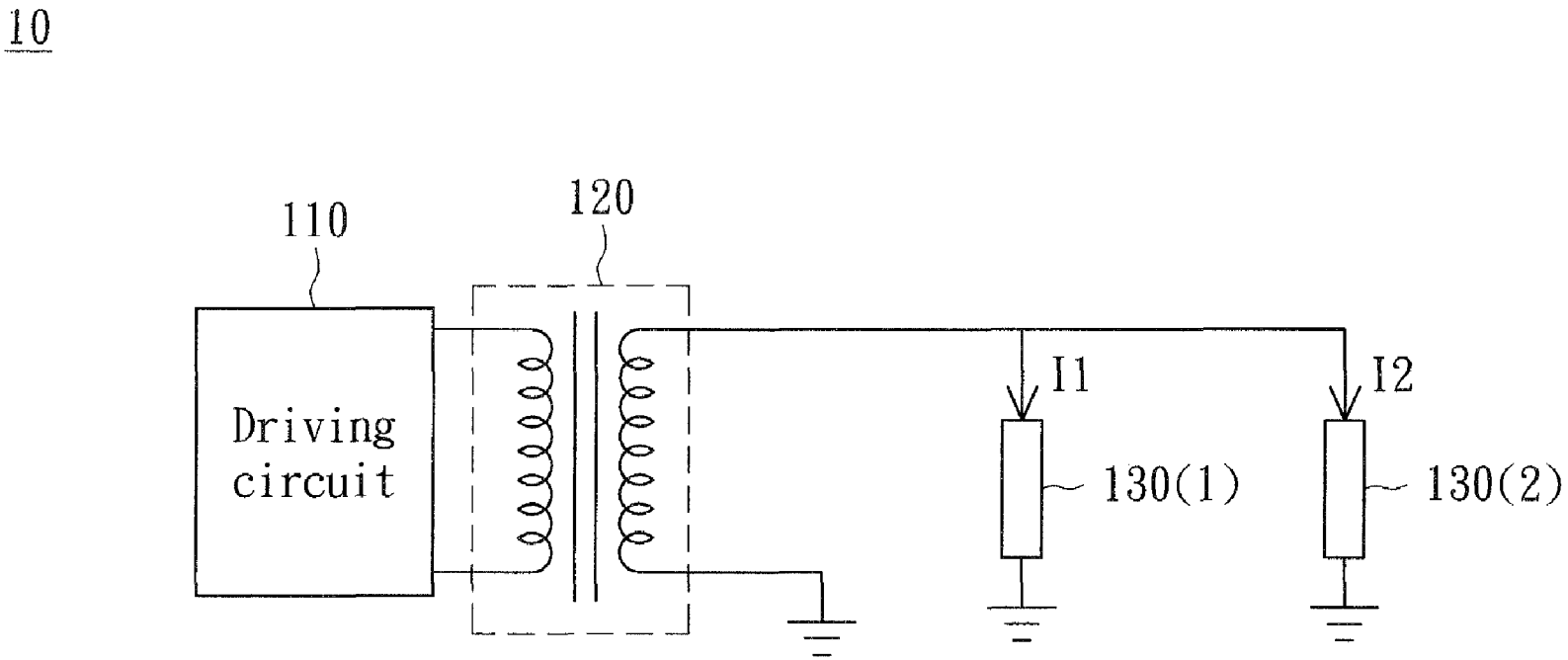
FIG. 1(PRIOR ART)
FIG. 1 is a perspective of a conventional backlight module.
Figure 2:
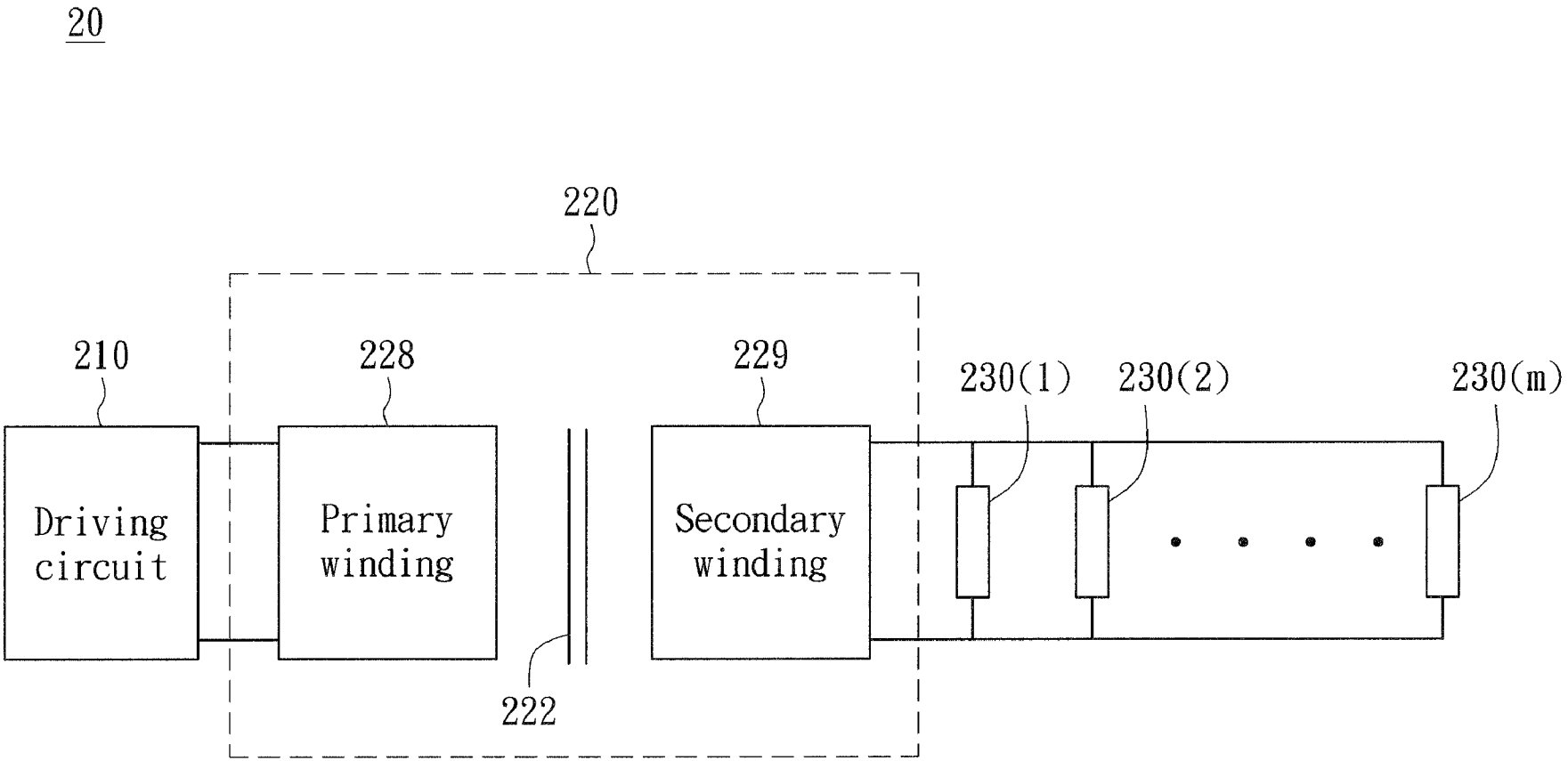
FIG. 2 is a perspective of a backlight module.
Figure 3:
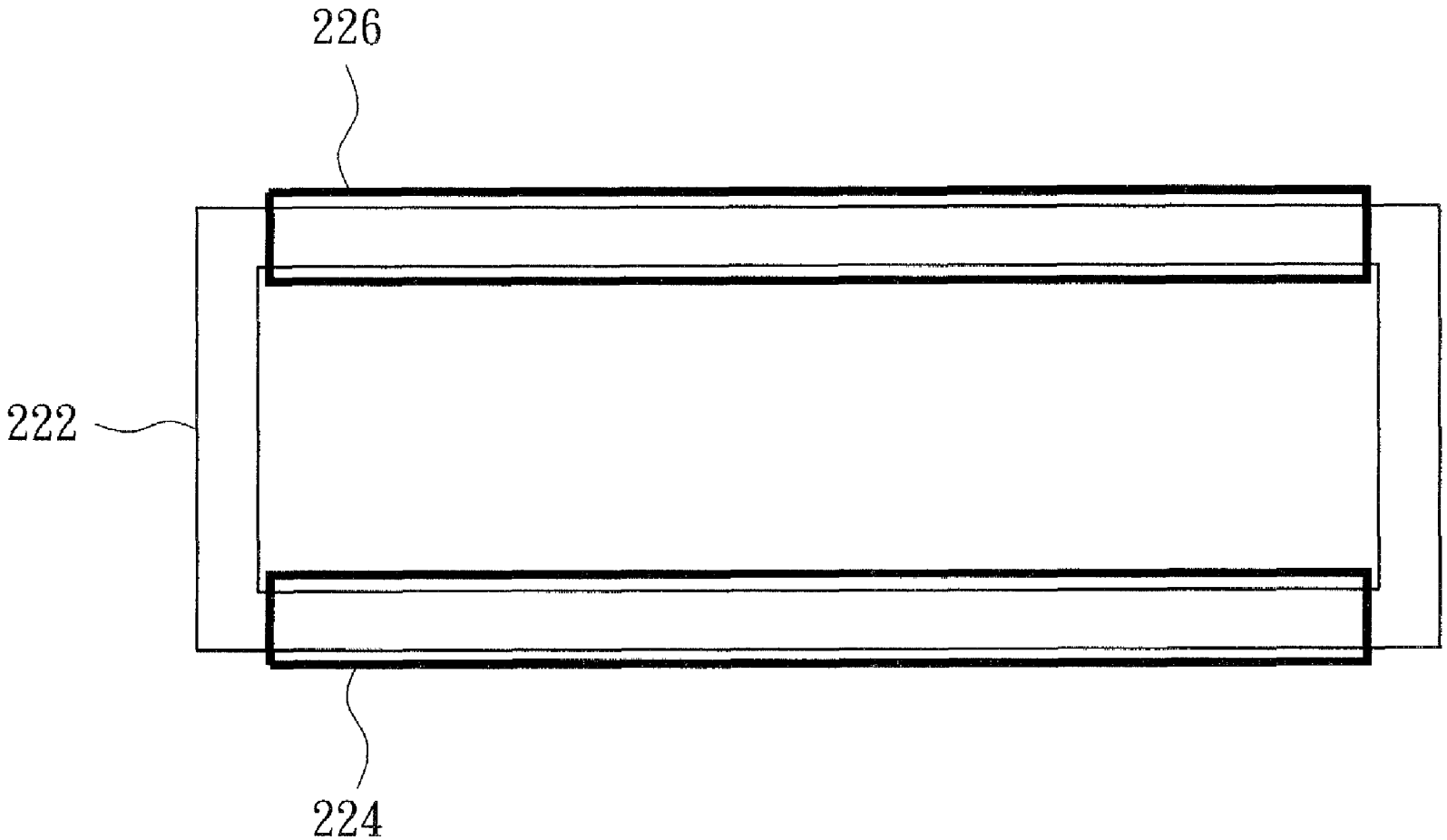
FIG. 3 is a perspective of a core and a bobbin.

Referring to both FIG. 2 and FIG. 3. FIG. 2 is a perspective of a backlight module. FIG. 3 is a perspective of a core and a bobbin. The backlight module 20 comprises a driving circuit 210, a transformer 220, and m lamps 230(1)~230(m), wherein m is a positive integer not equal to 0. The driving circuit 210 drives the lamps 230(1)~230(m) through the transformer 220.

The transformer 220 comprises a core 222, a first bobbin 224, a second bobbin 226, a primary winding 228 and a secondary winding 229. The core 222 has a first side and a second side. The first bobbin 224 and the second bobbin 226 are respectively disposed on the first side and the second side of the core 222 for winding around the primary winding 228 and the secondary winding 229. The core 222 can be formed by two U-shaped cores or by one U-shaped core and one I-shaped core. The first bobbin 224 and the second bobbin 226 can be separately formed in different pieces or integrally formed in one piece.

The primary winding 228 is formed by one or several primary coils. The secondary winding 229 is formed by several auxiliary coils whose turns are substantially equal and one secondary coil, or formed by several auxiliary coils whose turns are substantially equal and several secondary coils. The primary coil, the secondary coil and the auxiliary coils can selectively wind around the first bobbin 224 or the second bobbin 226 according to the needs of the design.

For the convenience of elaboration, the embodiments stated below are exemplified by several coils and several lamps, but the invention is not limited thereto. The number of the coils and that of the lamps can be adjusted according to the needs of the design.

First Embodiment

Figure 4:
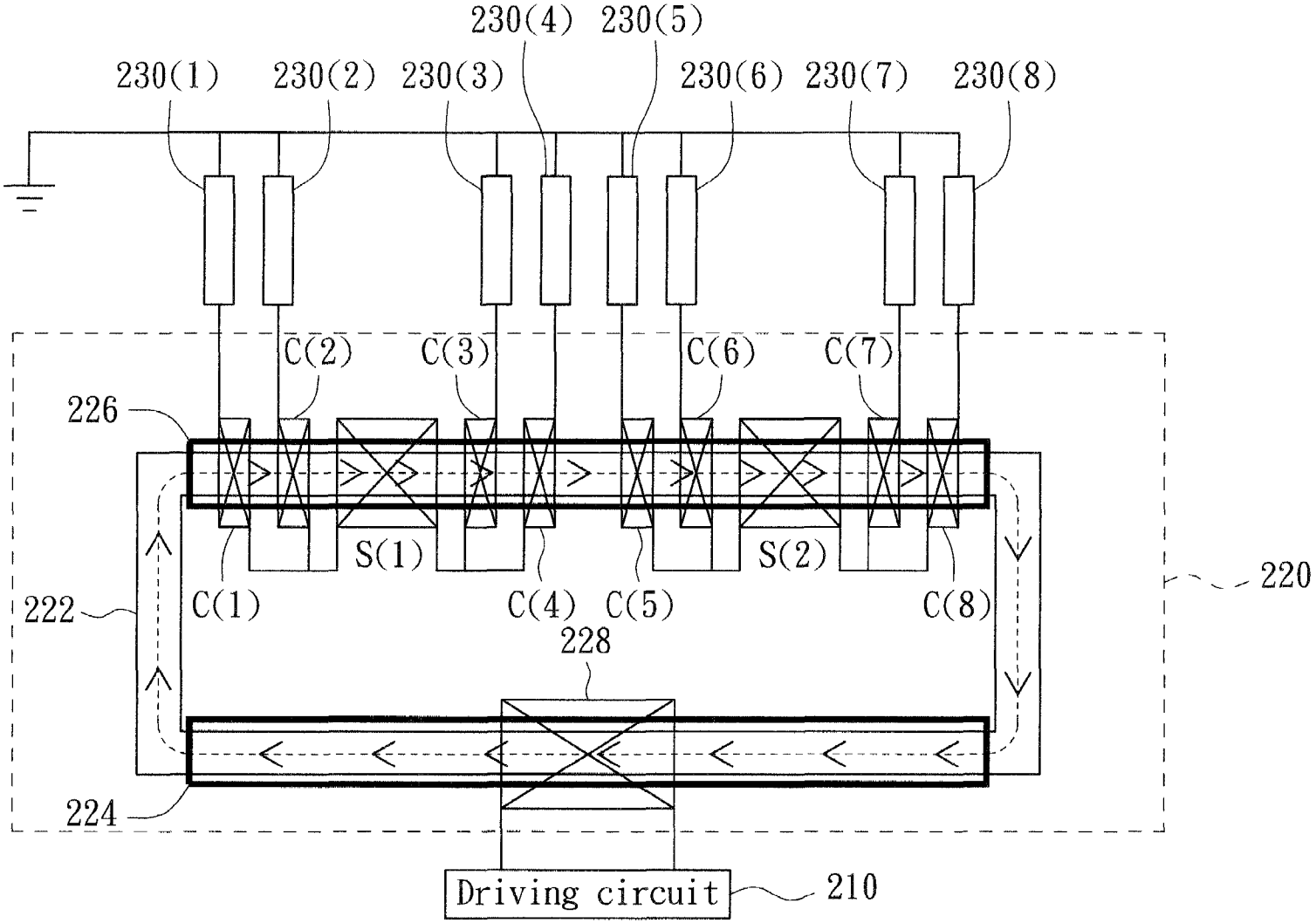
FIG. 4 is a structural diagram of a backlight module according to a first embodiment of the invention.
Figure 5:
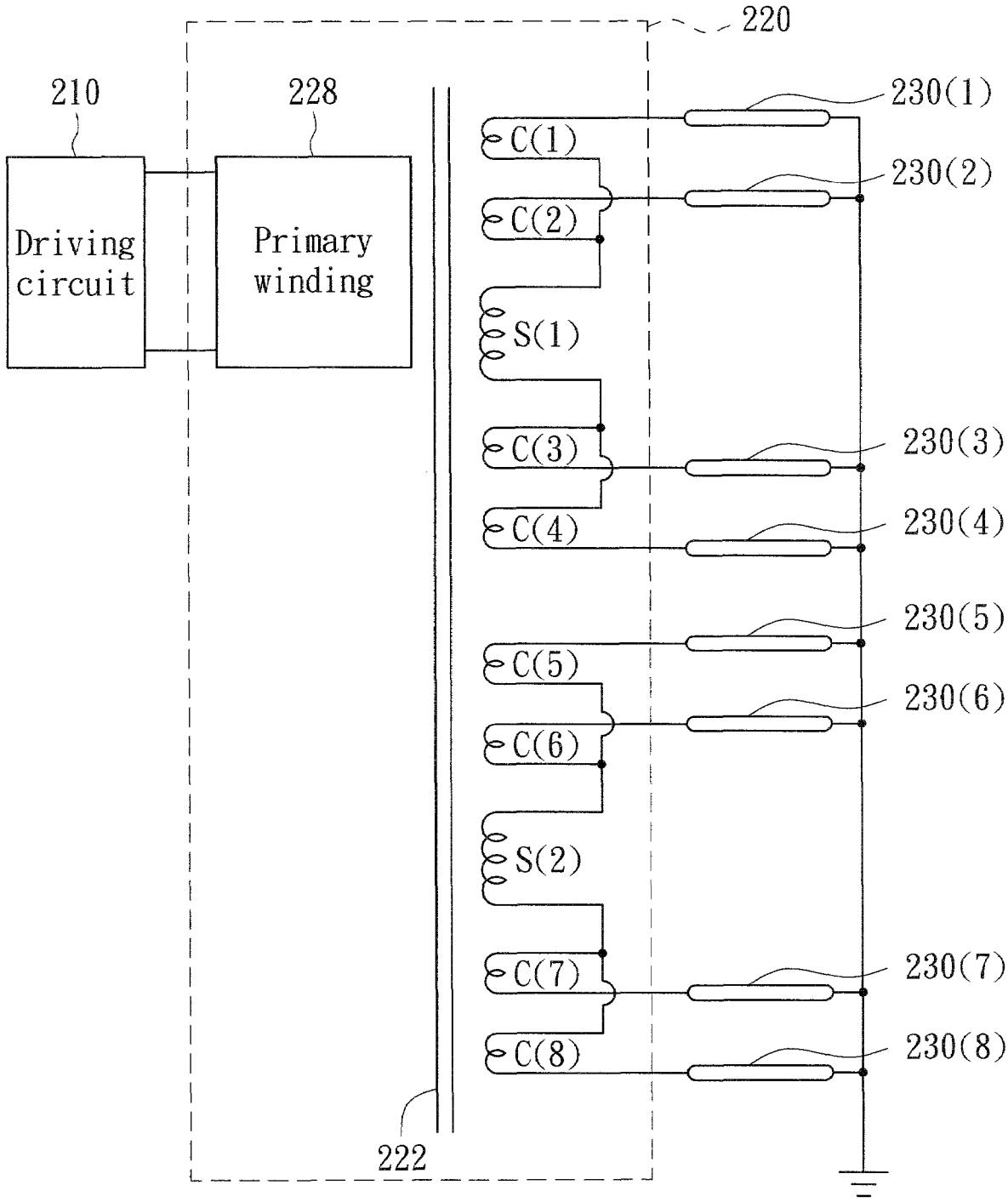
FIG. 5 is a circuit diagram of the backlight module according to the first embodiment of the invention.

Referring to both FIG. 4 and FIG. 5. FIG. 4 is a structural diagram of a backlight module according to a first embodiment of the invention. FIG. 5 is a circuit diagram of the backlight module according to the first embodiment of the invention. For simplification, the secondary winding 229 of FIG. 4 and FIG. 5 is exemplified by two secondary coils S(1)~S(2) and eight auxiliary coils C(1)~C(8).

In the first embodiment, the primary winding 228 winds around the first bobbin 224; the secondary coil S(1), the secondary coil S(2); the auxiliary coils C(1)~C(8) wind around the second bobbin 226. The primary winding 228 is coupled to the driving circuit 210. The lamps 230(1)~230(4) are coupled to the secondary coil S(1) through the auxiliary coils C(1)~C(4) respectively. The lamps 230(5)~230(8) are coupled to the secondary coil S(2) through the auxiliary coils C(5)~C(8) respectively.

Each of the auxiliary coils C(1)~C(8) has one end coupled to one end of one of the lamps 230(1)~230(8) respectively. Each of the lamps 230(1)~230(8) has the other end coupled to a grounding end.

Each of the auxiliary coils C(1)~C(2) has the other end coupled to one end of the secondary coil S(1). Each of the auxiliary coils C(3)~C(4) has the other end coupled to the other end of the secondary coil S(1).

Each of the auxiliary coils C(5)~C(6) has the other end coupled to one end of the secondary coil S(2). Each of the auxiliary coils C(7)~C(8) has the other end coupled to the other end of the secondary coil S(2).

As the turns of the auxiliary coils C(1)~C(8) are substantially equal and the auxiliary coils C(1)~C(8) correspond to the same magnetic path, the currents flowing through the lamps 230(1)~230(8) are substantially equal, hence prolonging the lifespan of the lamps and improving the uniformity of luminance.

Second Embodiment

Figure 6:
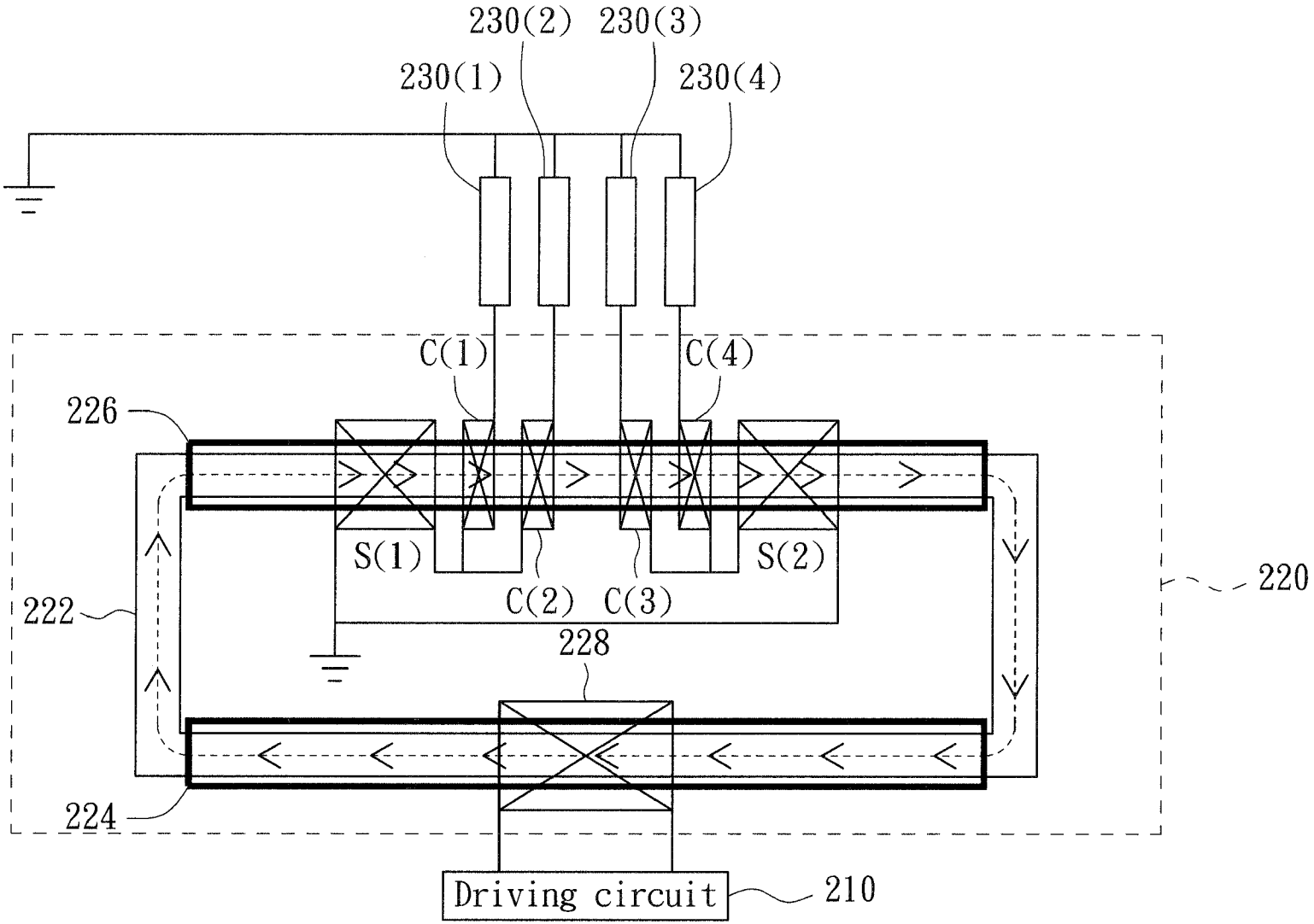
FIG. 6 is a structural diagram of a backlight module according to a second embodiment of the invention.
Figure 7:
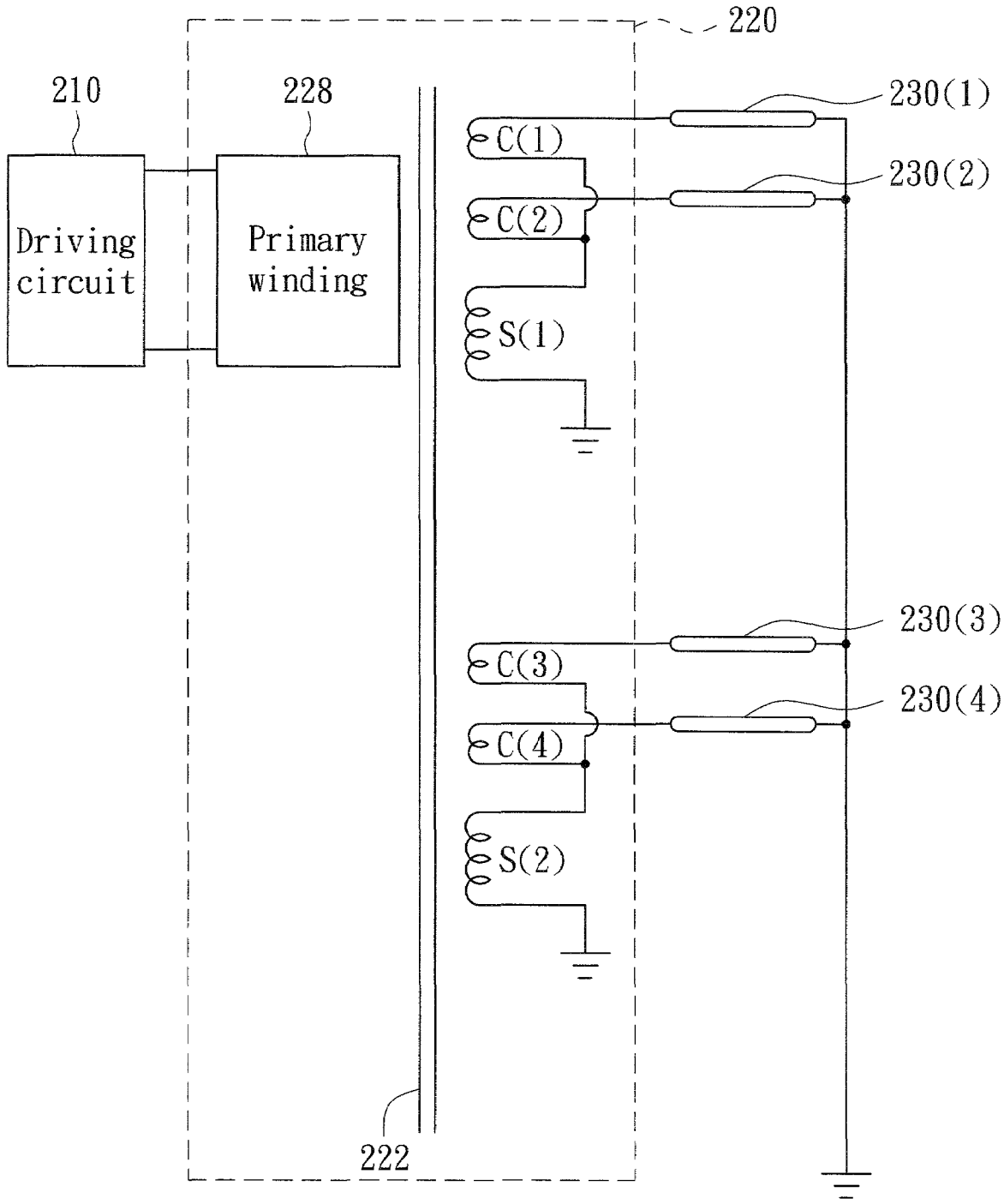
FIG. 7 is a circuit diagram of a backlight module according to the second embodiment of the invention.

Referring to both FIG. 6 and FIG. 7. FIG. 6 is a structural diagram of a backlight module according to a second embodiment of the invention. FIG. 7 is a circuit diagram of a backlight module according to the second embodiment of the invention. For simplification, the secondary winding 229 of FIG. 6 and FIG. 7 is exemplified by two secondary coils S(1)~S(2) and four auxiliary coils C(1)~C(4).

In the second embodiment, the primary winding 228 winds around the first bobbin 224, the secondary coil S(1), the secondary coil S(2); the auxiliary coils C(1)~C(4) wind around the second bobbin 226, and the auxiliary coils C(1)~C(4) wind between the secondary coils S(1)~S(2). The primary winding 228 is coupled to the driving circuit 210. The lamps 230(1)~230(2) are coupled to the secondary coil S(1) through the auxiliary coils C(1)~C(2) respectively. The lamps 230(3)~230(4) are coupled to the secondary coil S(2) through the auxiliary coils C(3)~C(4) respectively.

Each of the auxiliary coils C(1)~C(4) has one end respectively coupled to one end of one of the lamps 230(1)~230(4). Each of the lamps 230(1)~230(4) has the other end coupled to a grounding end.

Each of the auxiliary coils C(1)~C(2) has the other end coupled to one end of the secondary coil S(1). Each of the auxiliary coils C(3)~C(4) has the other end coupled to one end of the secondary coil S(2). Each of the secondary coils S(1)~S(2) has the other end coupled to a grounding end. Besides, the other end of the secondary coil S(1) and the other end of the secondary coil S(2) can be coupled directly without being grounded together.

As the turns of the auxiliary coils C(1)~C(4) are substantially equal and the auxiliary coils C(1)~C(4) correspond to the same magnetic path, the currents flowing through the lamps 230(1)~230(4) are also substantially equal.

Third Embodiment

Figure 8:
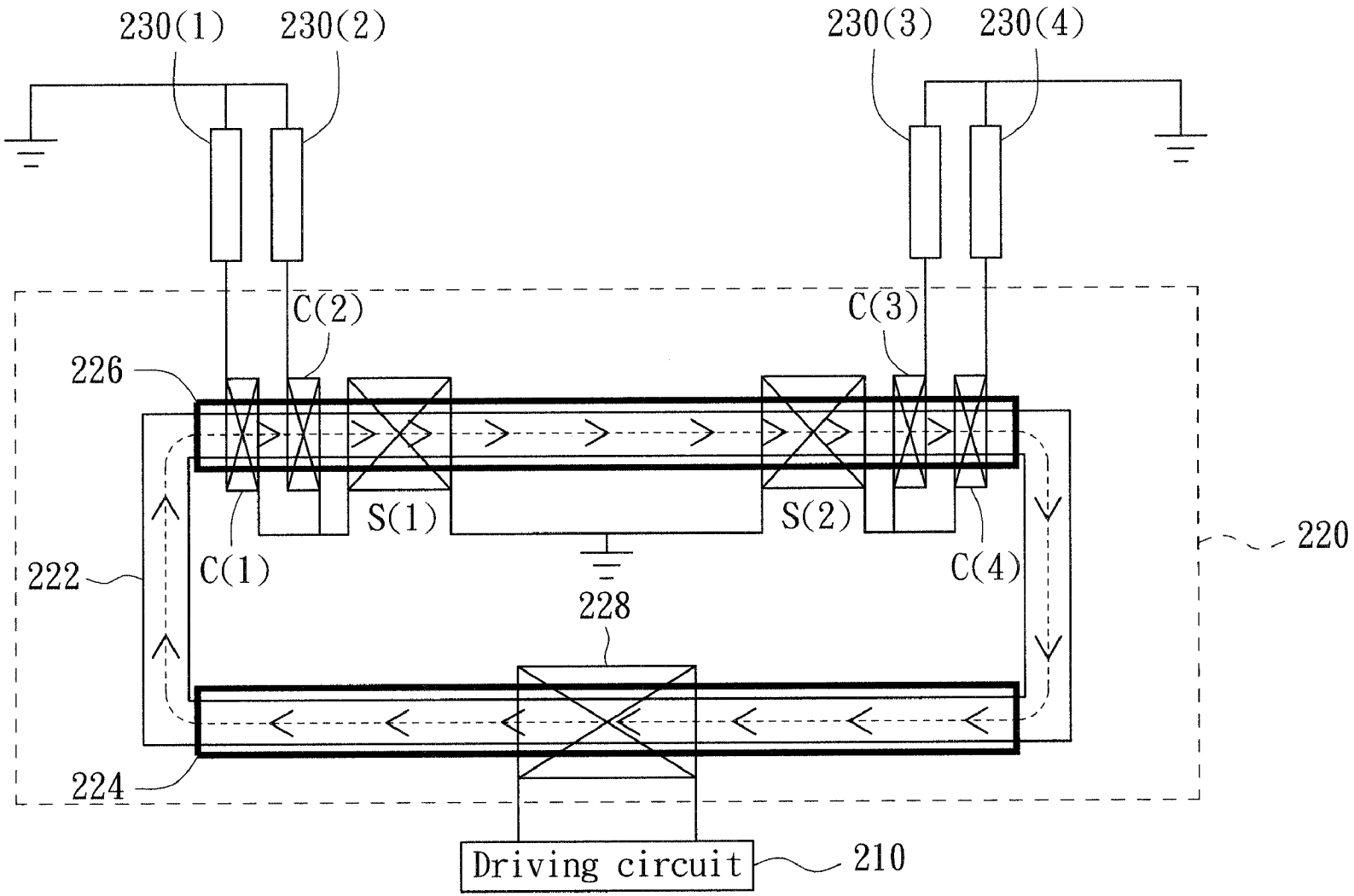
FIG. 8 is a structural diagram of a backlight module according to a third embodiment of the invention.
Figure 9:
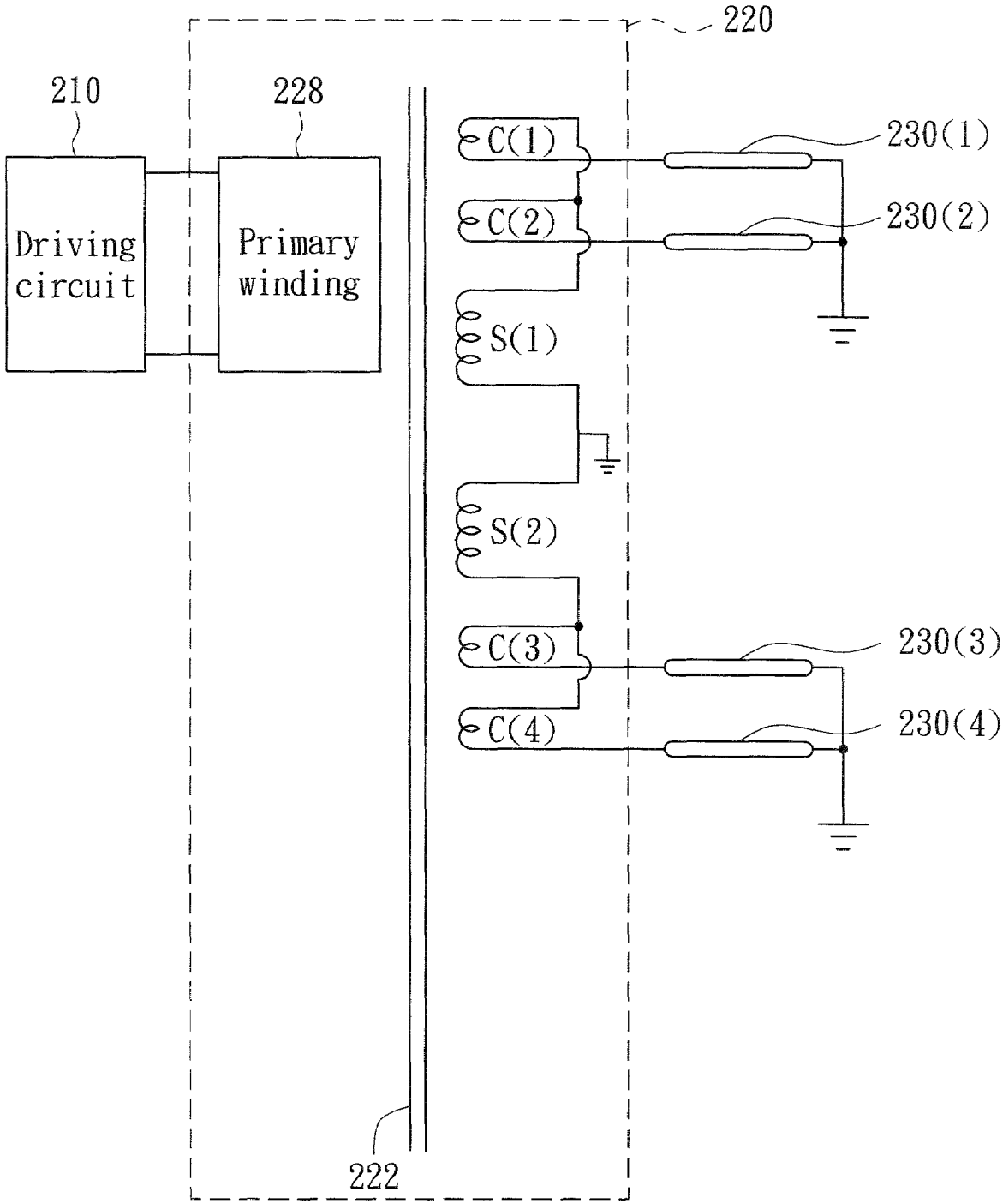
FIG. 9 is a circuit diagram of the backlight module according to the third embodiment of the invention.

Referring to both FIG. 8 and FIG. 9. FIG. 8 is a structural diagram of a backlight module according to a third embodiment of the invention. FIG. 9 is a circuit diagram of the backlight module according to the third embodiment of the invention is shown. For simplification, the secondary winding 229 of FIG. 8 and FIG. 9 is exemplified by two secondary coils S(1)~S(2) and four auxiliary coils C(1)~C(4).

In the second embodiment, the primary winding 228 winds around the first bobbin 224; the secondary coil S(1), the secondary coil S(2) and the auxiliary coils C(1)~C(4) wind around the second bobbin 226; the secondary coils S(1)~S(2) wind between the auxiliary coils C(1)~C(4). The primary winding 228 is coupled to the driving circuit 210. The lamps 230(1)~230(2) are coupled to the secondary coil S(1) through the auxiliary coils C(1)~C(2) respectively. The lamps 230(3)~230(4) are coupled to the secondary coil S(2) through the auxiliary coils C(3)~C(4) respectively.

Each of the auxiliary coils C(1)~C(4) has one end respectively coupled to one end of one of the lamps 230(1)~230(4). Each of the lamps 230(1)~230(4) has the other end coupled to a grounding end.

Each of the auxiliary coils C(1)~C(2) has the other end coupled to one end of the secondary coil S(1). Each of the auxiliary coils C(3)~C(4) has the other end coupled to one end of the secondary coil S(2). Each of the secondary coils S(1)~S(2) has the other end coupled to a grounding end together.

As the turns of the auxiliary coils C(1)~C(4) are substantially equal and the auxiliary coils C(1)~C(4) correspond to the same magnetic path, the currents flowing through the lamps 230(1)~230(4) are also substantially equal.

Fourth Embodiment

Figure 10:
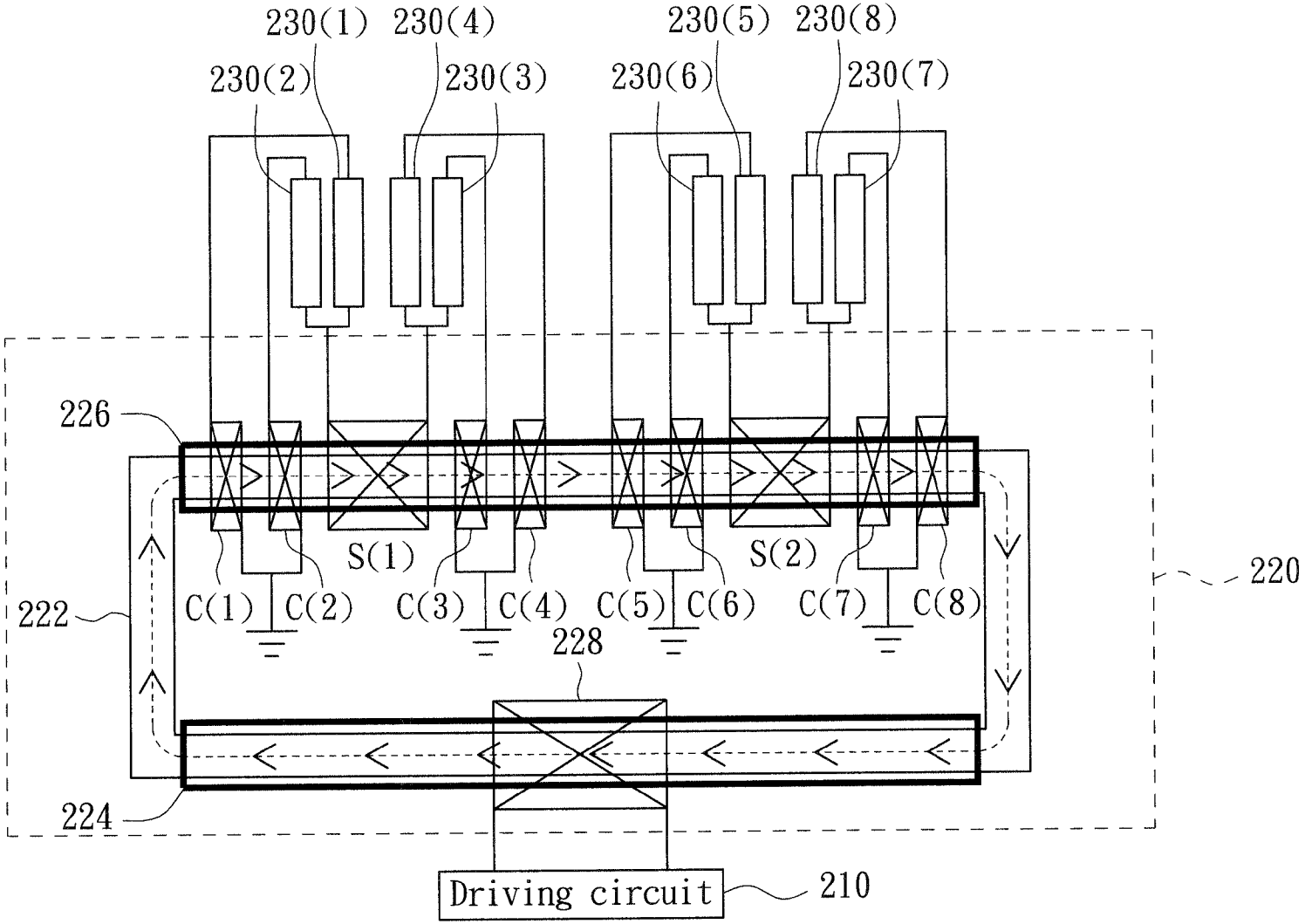
FIG. 10 is a structural diagram of a backlight module according to a fourth embodiment of the invention.
Figure 11:
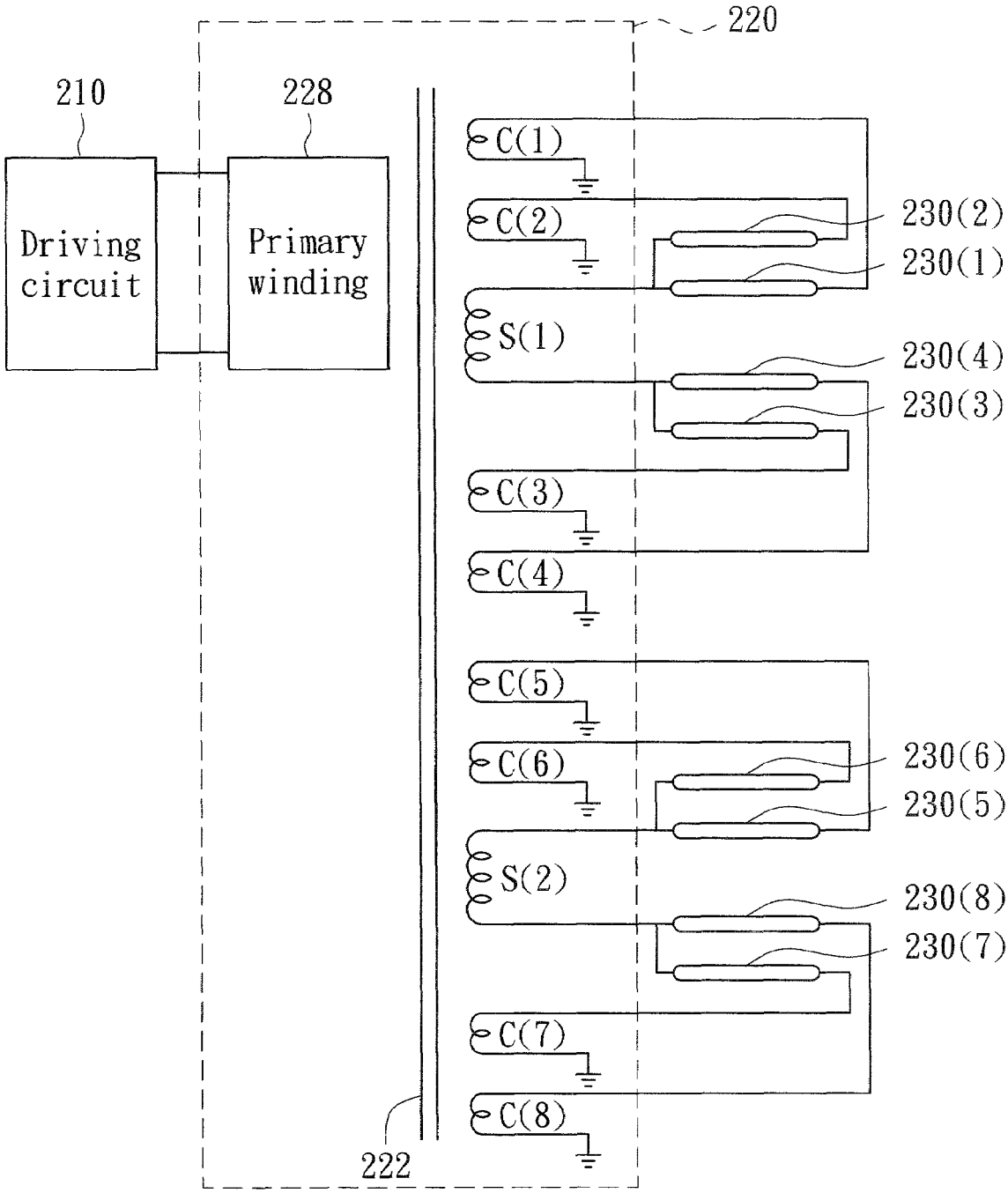
FIG. 11 is a circuit diagram of the backlight module according to the fourth embodiment of the invention.

Referring to both FIG. 10 and FIG. 11. FIG. 10 is a structural diagram of a backlight module according to a fourth embodiment of the invention. FIG. 11 is a circuit diagram of the backlight module according to the fourth embodiment of the invention. For simplification, the secondary winding 229 of the FIG. 10 and FIG. 11 is exemplified by two secondary coils S(1)~S(2) and eight auxiliary coils C(1)~C(8).

In the fourth embodiment, the primary winding 228 winds around the first bobbin 224; the secondary coil S(1), the secondary coil S(2) and the auxiliary coils C(1)~C(8) wind around the second bobbin 226. The primary winding 228 is coupled to the driving circuit 210. The auxiliary coils C(1)~C(4) are coupled to the secondary coil S(1) through the lamps 230(1)~230(4) respectively. The auxiliary coils C(5)~C(8) are coupled to the secondary coil S(2) through the lamps 230(5)~230(8) respectively.

Each of the auxiliary coils C(1)~C(8) has one end coupled to one end of one of the lamps 230(1)~230(8) respectively. Each of the lamps 230(1)~230(2) has the other end coupled to one end of the secondary coil S(1). Each of the lamps 230(3)~230(4) has the other end coupled to the other end of the secondary coil S(1). Each of the lamps 230(5)~230(6) has the other end coupled to one end of the secondary coil S(2). Each of the lamps 230(7)~230(8) has the other end coupled to the other end of the secondary coil S(2). Each of the auxiliary coils C(1)~C(8) has the other end coupled to a grounding end.

Likewise, as the turns of the auxiliary coils C(1)~C(8) are substantially equal and the auxiliary coils C(1)~C(8) correspond to the same magnetic path, the currents flowing through the lamps 230(1)~230(8) are also substantially equal.

Fifth Embodiment

Figure 12:
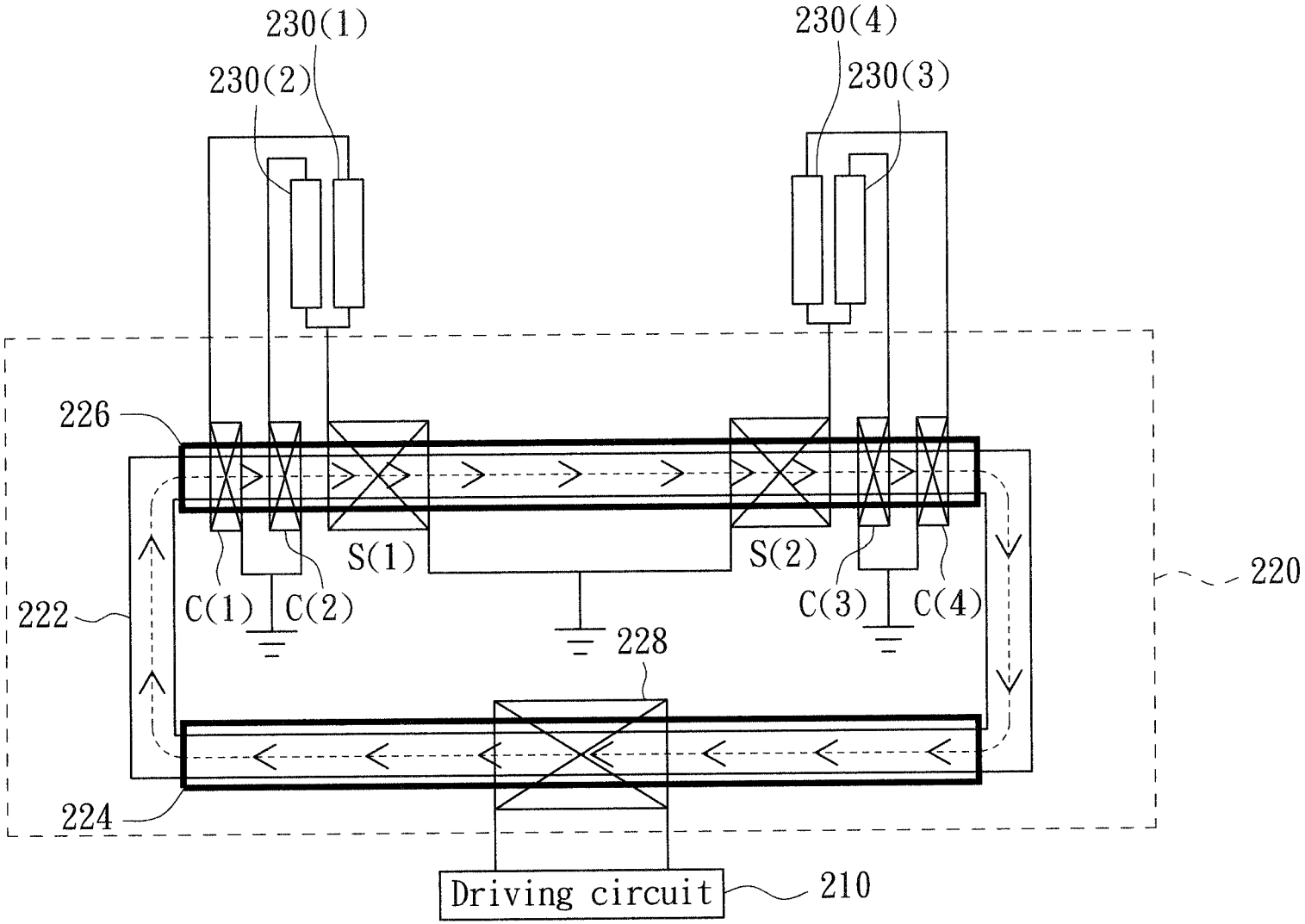
FIG. 12 is a structural diagram of a backlight module according to a fifth embodiment of the invention.
Figure 13:
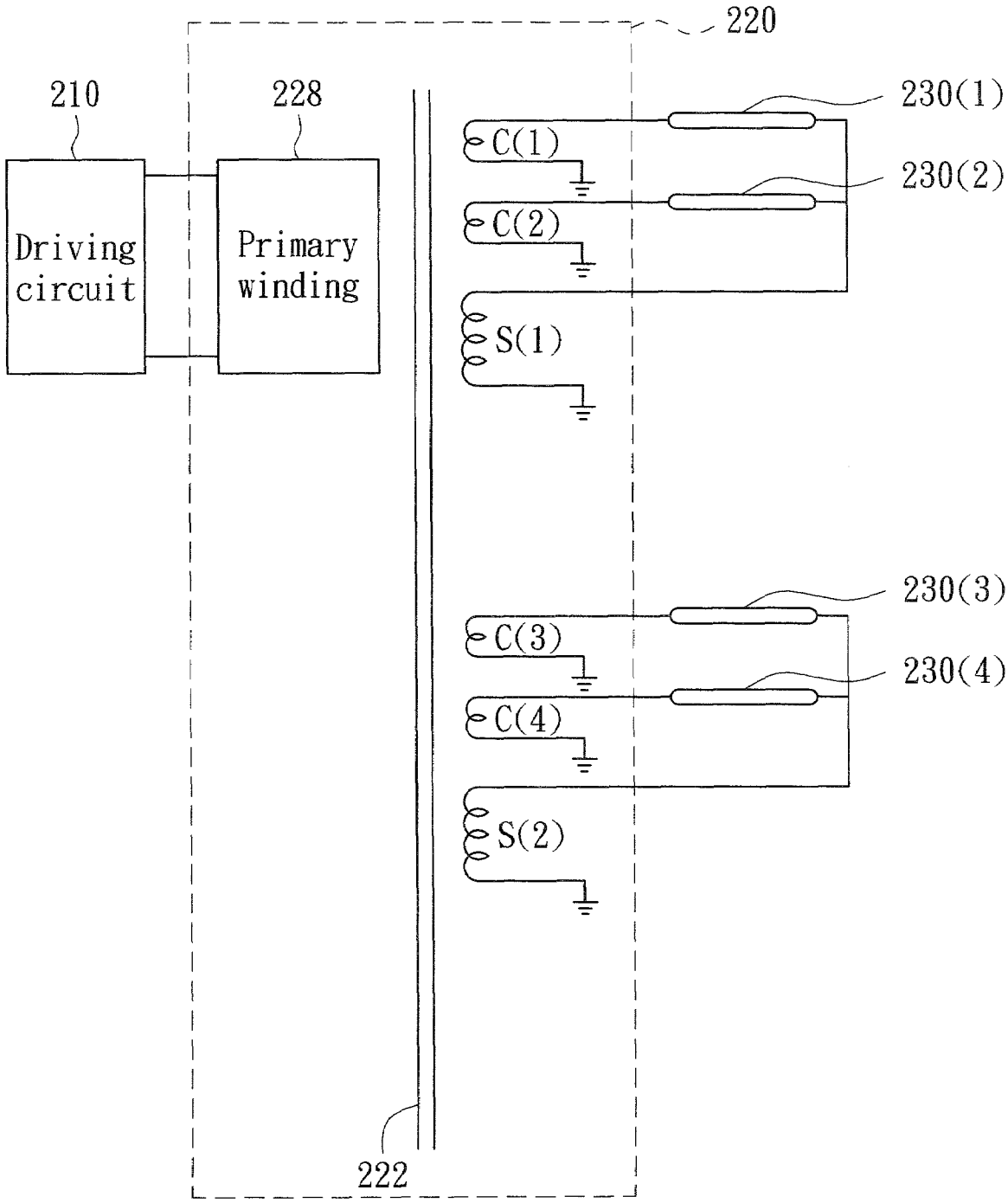
FIG. 13 is a circuit diagram of the backlight module according to the fifth embodiment of the invention.

Referring to both FIG. 12 and FIG. 13. FIG. 12 is a structural diagram of a backlight module according to a fifth embodiment of the invention. FIG. 13 is a circuit diagram of the backlight module according to the fifth embodiment of the invention. For simplification, the secondary winding 229 of FIG. 12 and FIG. 13 is exemplified by two secondary coils S(1)~S(2) and four auxiliary coils C(1)~C(4).

In the fifth embodiment, the primary winding 228 winds around the first bobbin 224; the secondary coil S(1), the secondary coil S(2) and the auxiliary coils C(1)~C(4) wind around the second bobbin 226; the secondary coils S(1)~S(2) wind between the auxiliary coils C(1)~C(4). The primary winding 228 is coupled to the driving circuit 210. The auxiliary coils C(1)~C(2) are coupled to the secondary coil S(1) through the lamps 230(1)~230(2) respectively. The auxiliary coils C(3)~C(4) are coupled to the secondary coil S(2) through the lamps 230(3)~230(4) respectively.

Each of the auxiliary coils C(1)~C(4) has one end coupled to one end of one of the lamps 230(1)~230(4) respectively. Each of the lamps 230(1)~230(2) has the other end coupled to one end of the secondary coil S(1). Each of the lamps 230(3)~230(4) has the other end coupled to one end of the secondary coil S(2). Each of the secondary coils S(1)~S(2) has the other end coupled to a grounding end and each of the auxiliary coils C(1)~C(4) has the other end coupled to the grounding end. Besides, the other end of the secondary coil S(1) and the other end of the secondary coil S(2) can be coupled directly without being grounded together.

Likewise, as the turns of the auxiliary coils C(1)~C(4) are substantially equal and the auxiliary coils C(1)~C(4) correspond to the same magnetic path, the currents flowing through the lamps 230(1)~230(4) are also substantially equal.

Sixth Embodiment

Figure 14:
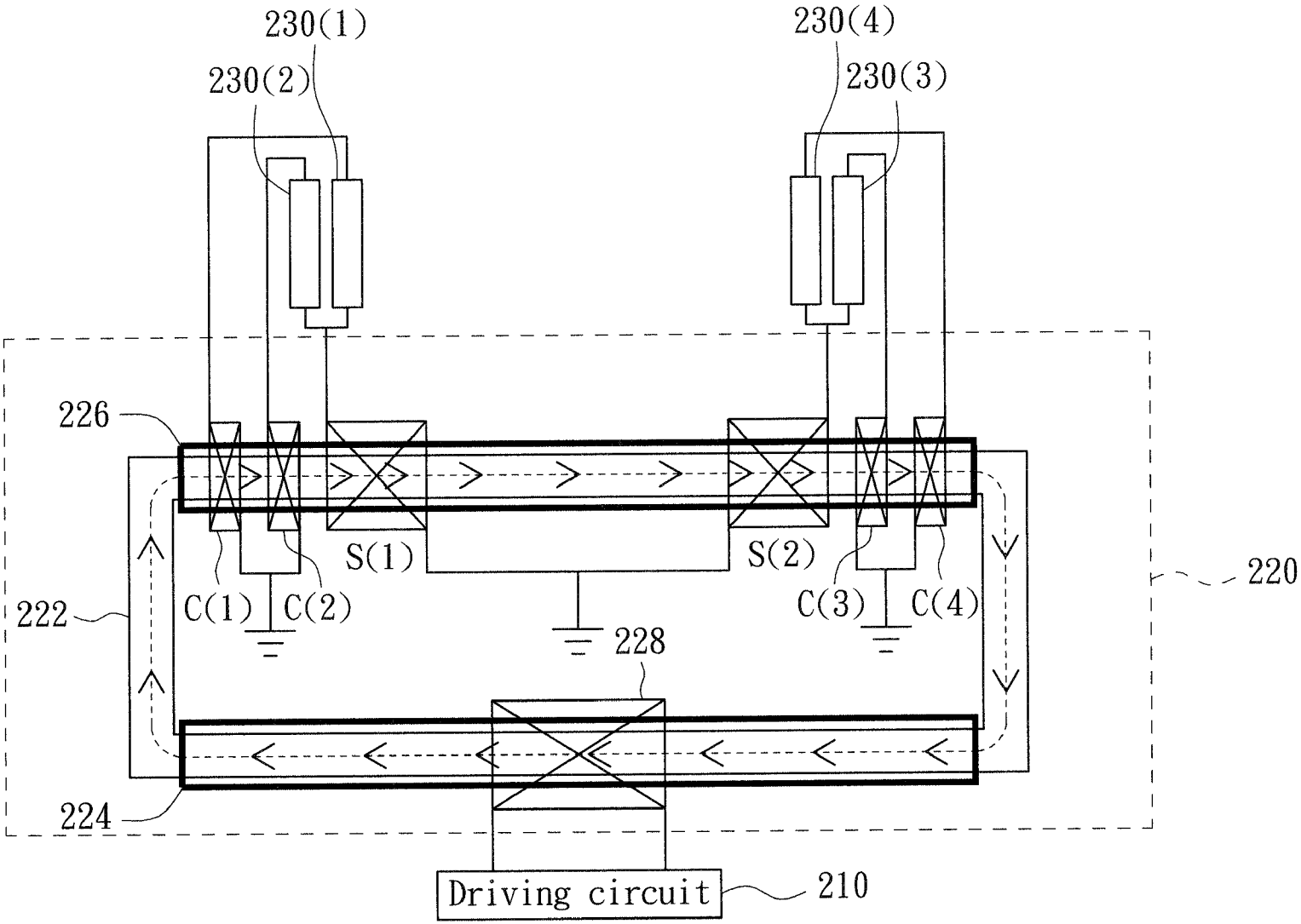
FIG. 14 is a structural diagram of the backlight module according to the fifth embodiment of the invention.
Figure 15:
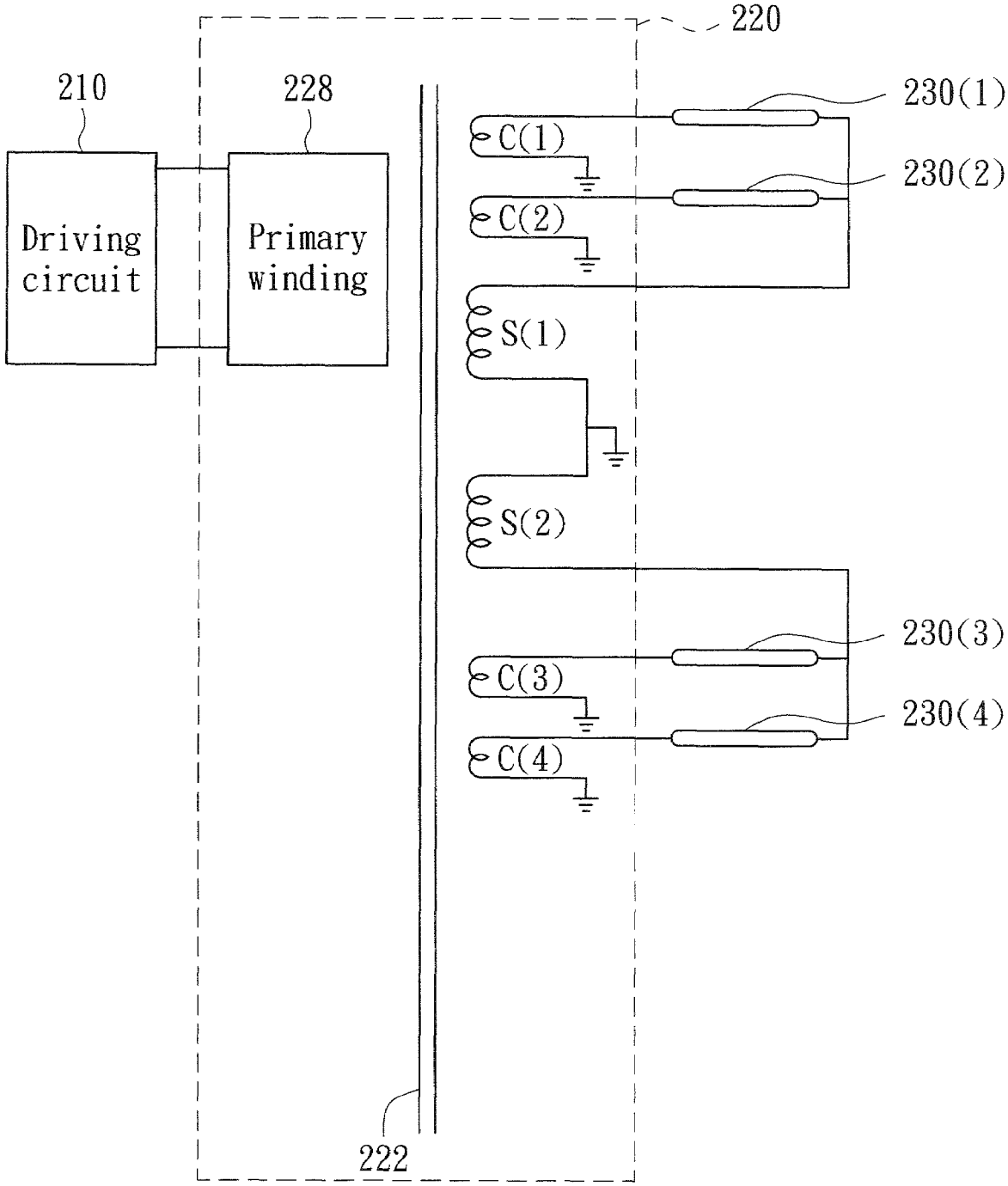
FIG. 15 is a circuit diagram of a backlight module according to a sixth embodiment of the invention.

Referring to both FIG. 14 and FIG. 15. FIG. 14 is a structural diagram of the backlight module according to the fifth embodiment of the invention. FIG. 15 is a circuit diagram of a backlight module according to a sixth embodiment of the invention. For simplification, the secondary winding 229 of FIG. 14 and FIG. 15 is exemplified by two secondary coils S(1)~S(2) and four auxiliary coils C(1)~C(4).

In the sixth embodiment, the primary winding 228 winds around the first bobbin 224; the secondary coil S(1), the secondary coil S(2) and the auxiliary coils C(1)~C(4) wind around the second bobbin 226; the secondary coils S(1)~S(2) wind between the auxiliary coils C(1)~C(4). The primary winding 228 is coupled to the driving circuit 210. The auxiliary coils C(1)~C(2) are coupled to the secondary coil S(1) through the lamps 230(1)~230(2) respectively. The auxiliary coils C(3)~C(4) are coupled to the secondary coil S(2) through the lamps 230(3)~230(4) respectively.

Each of the auxiliary coils C(1)~C(4) has one end coupled to one end of one of the lamps 230(1)~230(4) respectively. Each of the lamps 230(1)~230(2) has the other end coupled to one end of the secondary coil S(1). Each of the lamps 230(3)~230(4) has the other end coupled to one end of the secondary coil S(2). Each of the secondary coils S(1)~S(2) has the other end coupled to a grounding end and each of the auxiliary coils C(1)~C(4) has the other end coupled to the grounding end.

Likewise, as the turns of the auxiliary coils C(1)~C(4) are substantially equal and the auxiliary coils C(1)~C(4) correspond to the same magnetic path, the currents flowing through the lamps 230(1)~230(4) are also substantially equal.

Seventh Embodiment

Figure 16:
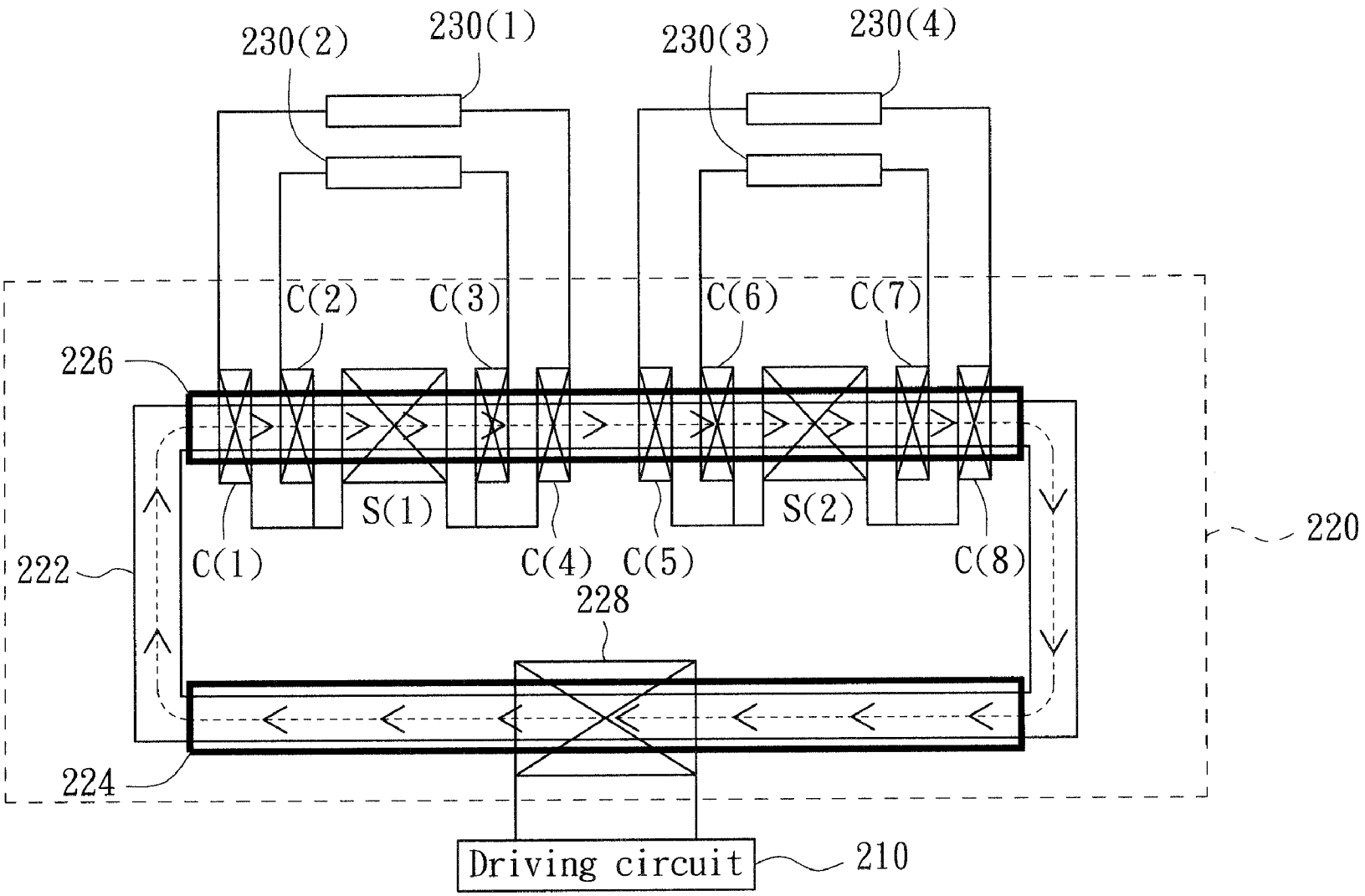
FIG. 16 is a structural diagram of a backlight module according to a seventh embodiment of the invention.
Figure 17:
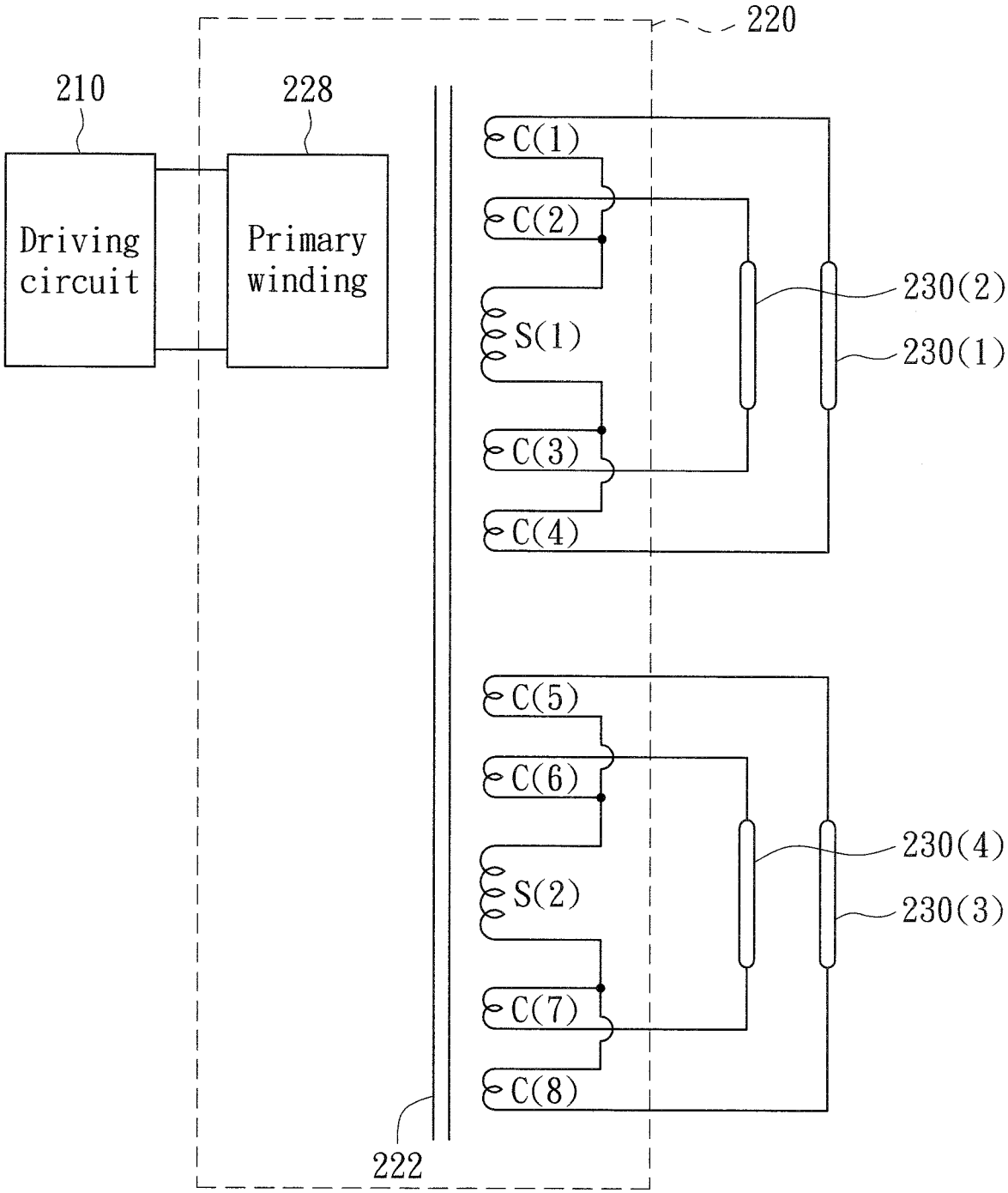
FIG. 17 is a circuit diagram of the backlight module according to the seventh embodiment of the invention.

Referring to both FIG. 16 and FIG. 17. FIG. 16 is a structural diagram of a backlight module according to a seventh embodiment of the invention. FIG. 17 is a circuit diagram of the backlight module according to the seventh embodiment of the invention. For simplification the secondary winding 229 of FIG. 16 and FIG. 17 is exemplified by two secondary coils S(1)~S(2) and eight auxiliary coils C(1)~C(8).

In the seventh embodiment the primary winding 228 winds around the first bobbin 224; the secondary coil S(1), the secondary coil S(2) and the auxiliary coils C(1)~C(8) wind around the second bobbin 226. The primary winding 228 is coupled to the driving circuit 210. The lamps 230(1)~230(2) are coupled to the secondary coil S(1) through the auxiliary coils C(1)~C(4) respectively. The lamps 230(3)~230(4) are coupled to the secondary coil S(2) through the auxiliary coils C(5)~C(8) respectively.

Each of the auxiliary coils C(1)~C(2) has one end coupled to one end of one of the lamps 230(1)~230(2) respectively, and each of the auxiliary coils C(1)~C(2) has the other end coupled to one end of the secondary coil S(1). Each of the auxiliary coils C(3)~C(4) has one end coupled to the other end of one of the lamps 230(1)~230(2) respectively, and each of the auxiliary coils C(3)~C(4) has the other end coupled to the other end of the secondary coil S(1).

Each of the auxiliary coils C(5)~C(6) has one end coupled to one end of one of the lamps 230(3)~230(4) respectively. Each of the auxiliary coils C(5)~C(6) has the other end is coupled to one end of the secondary coil S(2). Each of the auxiliary coils C(7)~C(8) has one end coupled to the other end of one of the lamps 230(3)~230(4) respectively. Each of the auxiliary coils C(7)~C(8) has the other end coupled to the other end of the secondary coil S(2).

Likewise, as the turns of the auxiliary coils C(1)~C(8) are substantially equal and the auxiliary coils C(1)~C(8) correspond to the same magnetic path, the currents flowing through the lamps 230(1)~230(4) are also substantially equal. Besides, by driving the circuit from both sides, the turns of the secondary coils S(1)~S(2) are largely decreased, so that the transformer 220 has a thinner size and a smaller volume.

Eighth Embodiment

Figure 18:
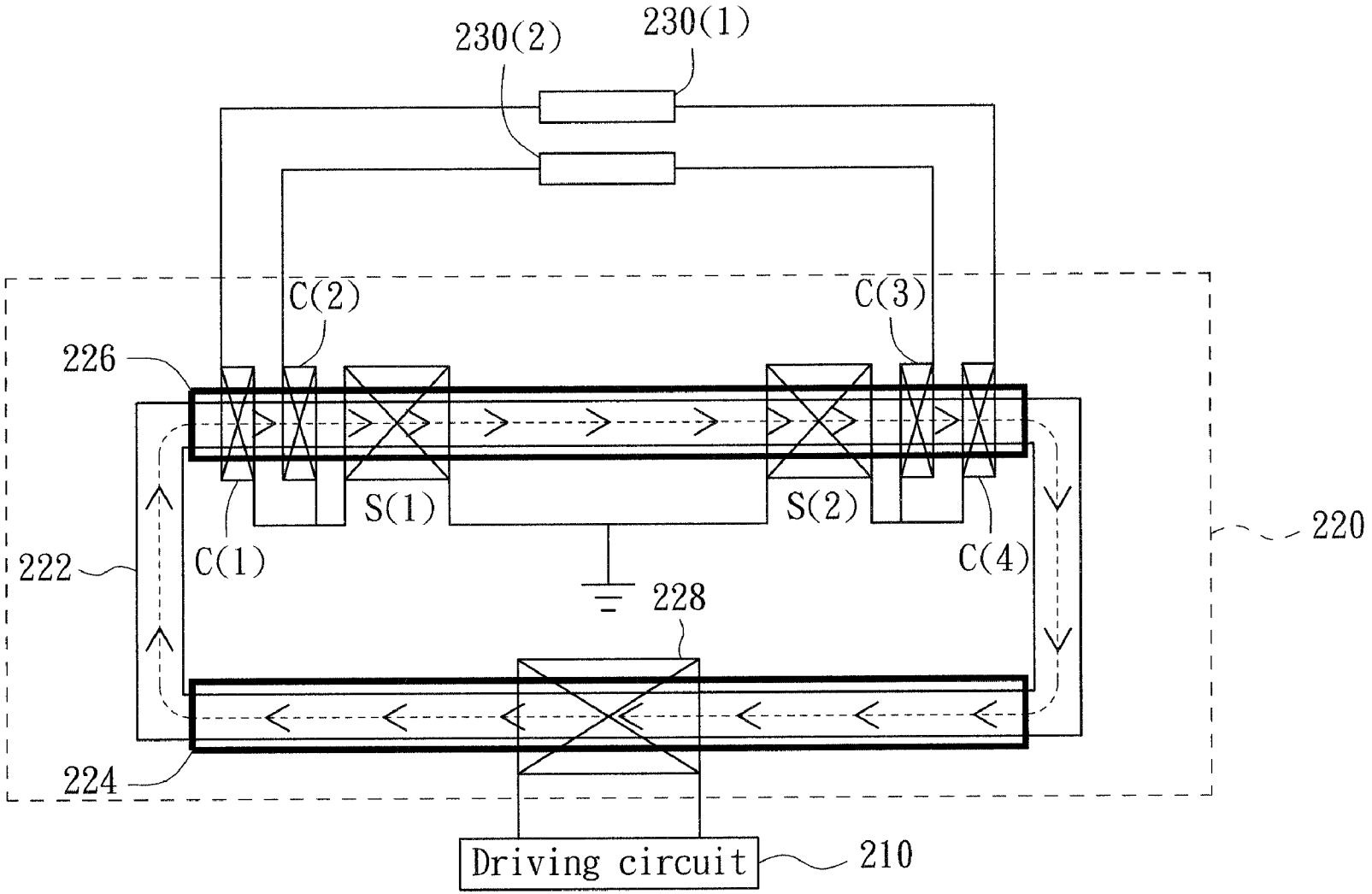
FIG. 18 is a structural diagram of a backlight module according to an eighth embodiment of the invention.
Figure 19:
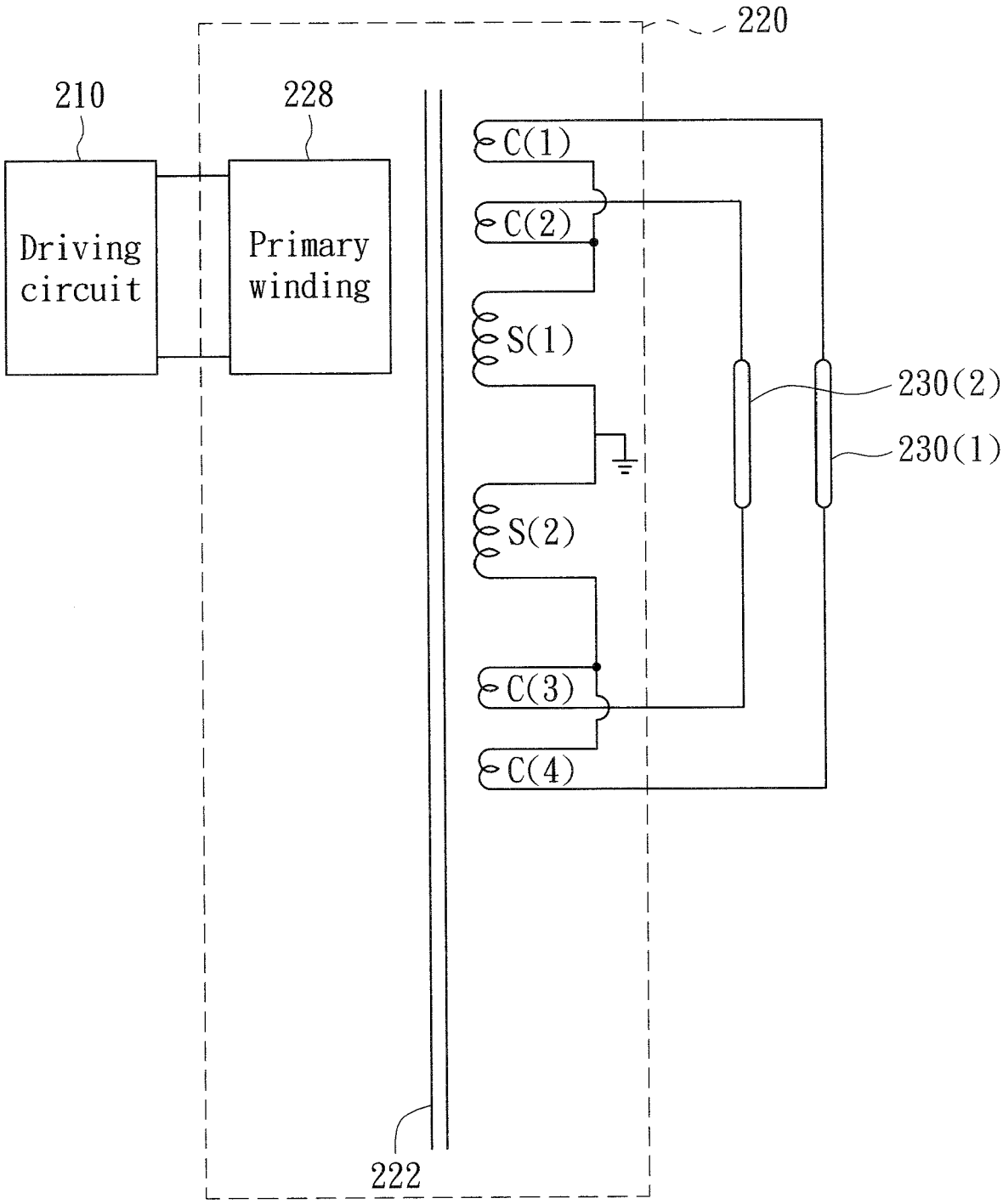
FIG. 19 is a circuit diagram of the backlight module according to the eighth embodiment of the invention.

Referring to both FIG. 18 and FIG. 19. FIG. 18 is a structural diagram of a backlight module according to an eighth embodiment of the invention. FIG. 19 is a circuit diagram of the backlight module according to the eighth embodiment of the invention. For simplification, the secondary winding 229 of FIG. 18 and FIG. 19 is exemplified by two secondary coils S(1)~S(2) and four auxiliary coils C(1)~C(4).

In the eighth embodiment, the primary winding 228 winds around the first bobbin 224; the secondary coil S(1), the secondary coil S(2) and the auxiliary coils C(1)~C(4) wind around the second bobbin 226; the secondary coils S(1)~S(2) wind between the auxiliary coils C(1)~C(4). The primary winding 228 is coupled to the driving circuit 210. The lamps 230(1)~230(2) are coupled to the secondary coils S(1)~S(2) through the auxiliary coils C(1)~C(4) respectively.

Each of the auxiliary coils C(1)~C(2) has one end coupled to one end of one of the lamps 230(1)~230(2) respectively. Each of the auxiliary coils C(1)~C(2) has the other end coupled to one end of the secondary coil S(1). Each of the auxiliary coils C(3)~C(4) has one end coupled to the other end of one of the lamps 230(1)~230(2) respectively. Each of the auxiliary coils C(3)~C(4) has the other end coupled to one end of the secondary coil S(2). Each of the secondary coils S(1)~S(2) has the other end coupled to a grounding end together.

Likewise, as the turns of the auxiliary coils C(1)~C(4) are substantially equal and the auxiliary coils C(1)~C(4) correspond to the same magnetic path, the currents flowing through the lamps 230(1)~230(2) are also substantially equal. Besides, by driving the circuit from both sides, the turns of the secondary coils S(1)~S(2) are largely decreased, so that the transformer 220 has a thinner size and a smaller volume.

Ninth Embodiment

Figure 20:
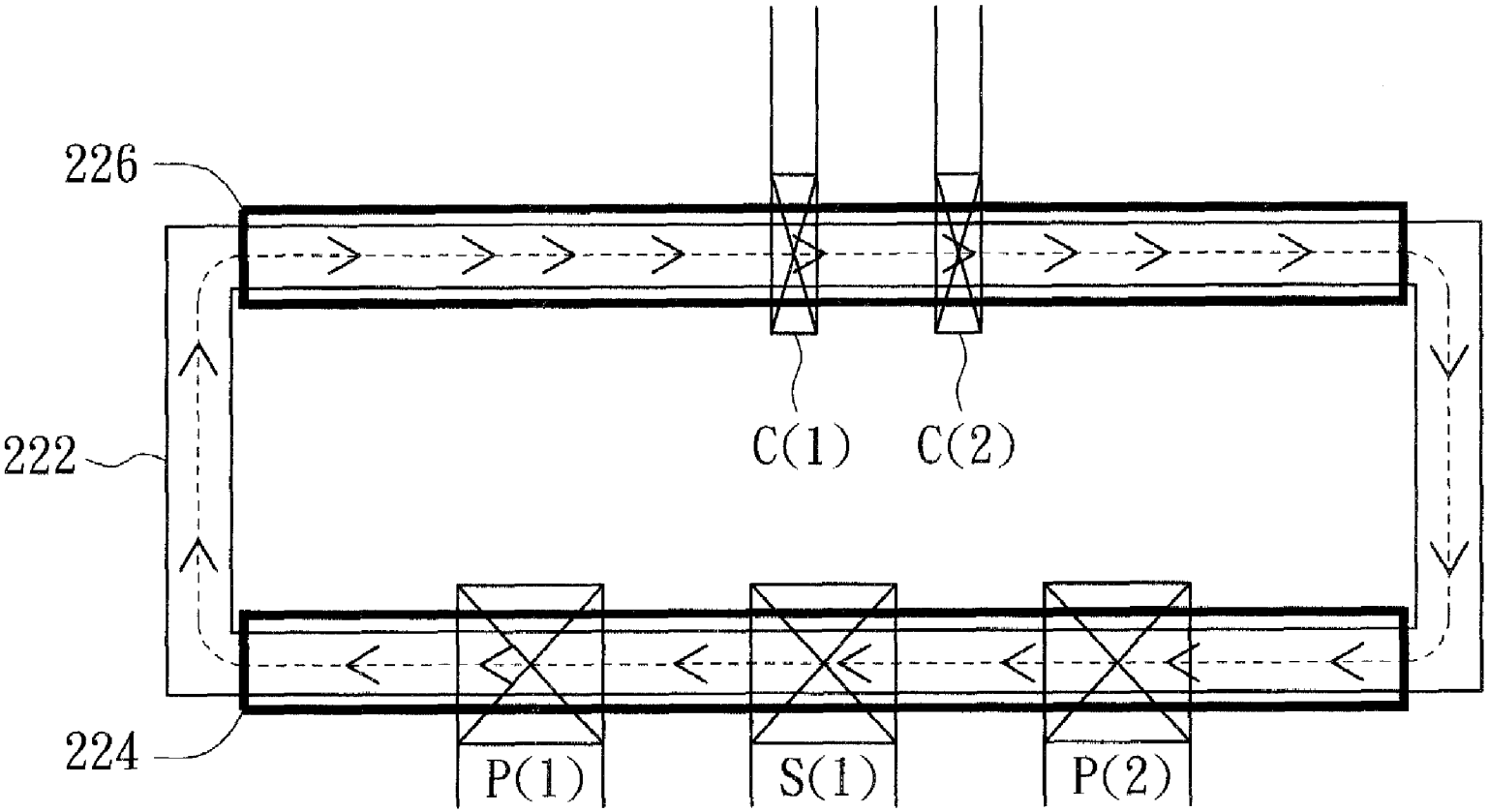
FIG. 20 is a structural diagram of a backlight module according to a ninth embodiment of the invention.
Figure 21:
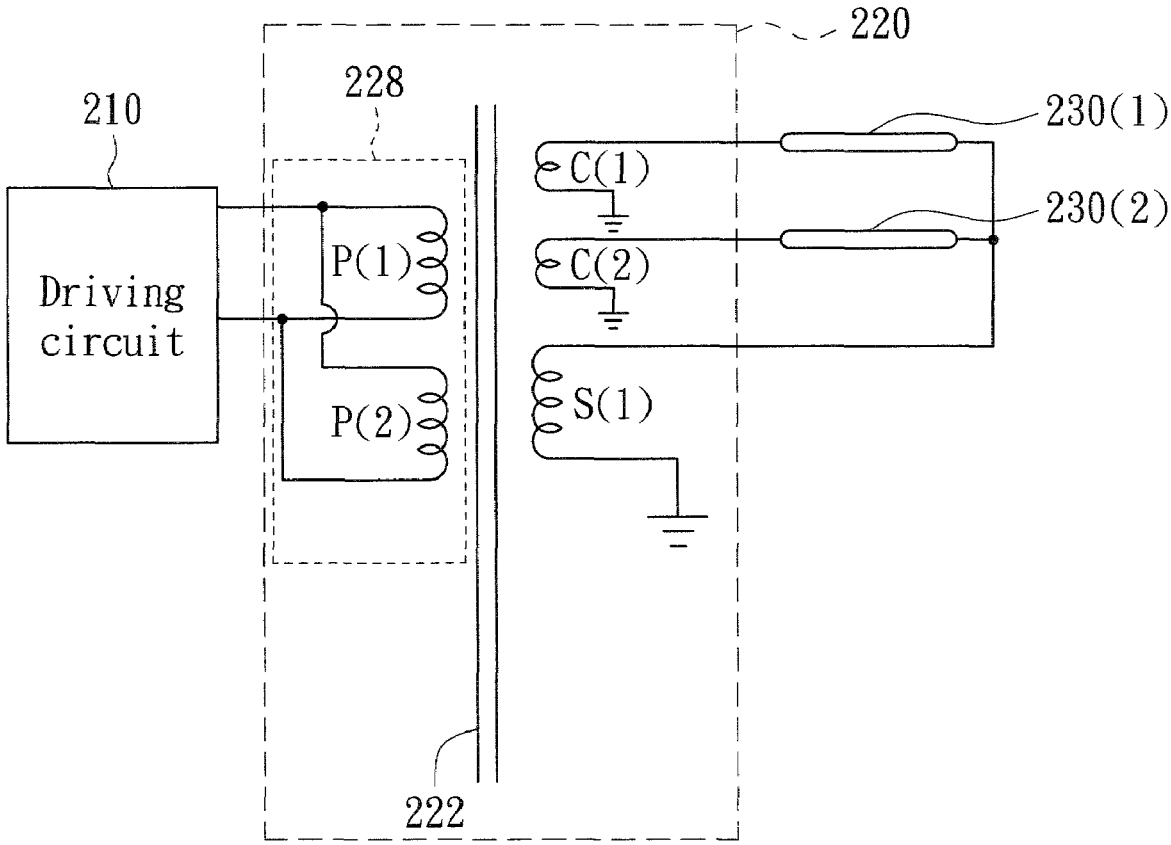
FIG. 21 is a circuit diagram of the backlight module according to the ninth embodiment of the invention.

Referring to both FIG. 20 and FIG. 21. FIG. 20 is a structural diagram of a backlight module according to a ninth embodiment of the invention. FIG. 21 is a circuit diagram of the backlight module according to the ninth embodiment of the invention. For simplification, the primary winding 228 of FIG. 20 and FIG. 21 is exemplified by two primary coils P(1)~P(2), and the secondary winding 229 is exemplified by a secondary coil S(1) and two auxiliary coils C(1)~C(2).

In the ninth embodiment, the primary coils P(1)~P(2) and the secondary coil S(1) winds around the first bobbin 224; the auxiliary coils C(1)~C(2) wind around the second bobbin 226. The primary coils P(1)~P(2) is coupled to the driving circuit 210. The auxiliary coils C(1)~C(2) are coupled to the secondary coil S(1) through the lamps 230(1)~230(2) respectively.

Each of the auxiliary coils C(1)~C(2) has one end coupled to one end of one of the lamps 230(1)~230(2) respectively. Each of the lamps 230(1)~230(2) has the other end coupled to one end of the secondary coil S(1). The other end of the secondary coil S(1) is coupled to a grounding end.

Likewise, as the turns of the auxiliary coils C(1)~C(2) are substantially equal and the auxiliary coils C(1)~C(2) correspond to the same magnetic path, the currents flowing through the lamps 230(1)~230(2) are also substantially equal.

Tenth Embodiment

Figure 22:
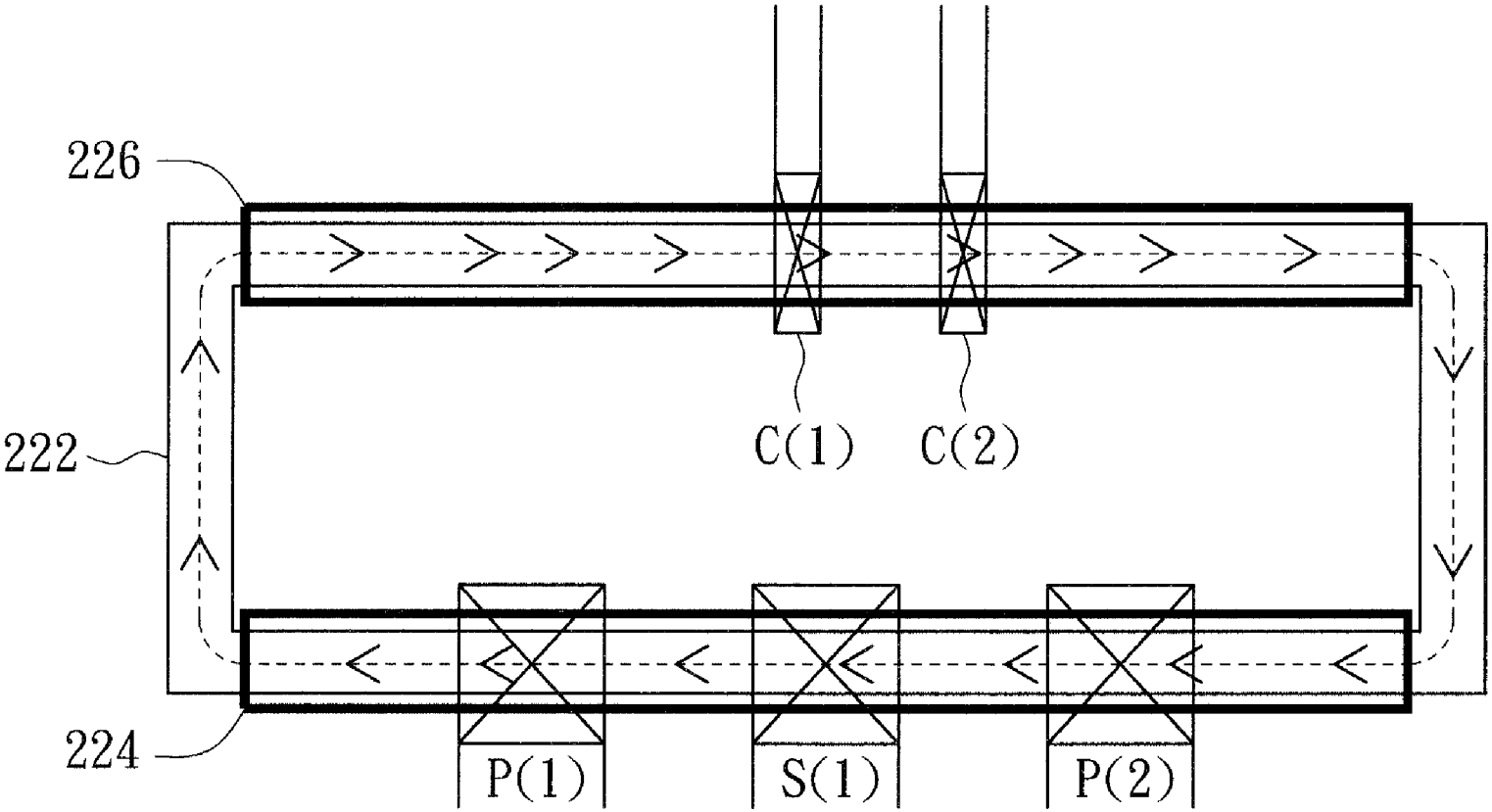
FIG. 22 is a structural diagram of a backlight module according to a tenth embodiment of the invention.
Figure 23:
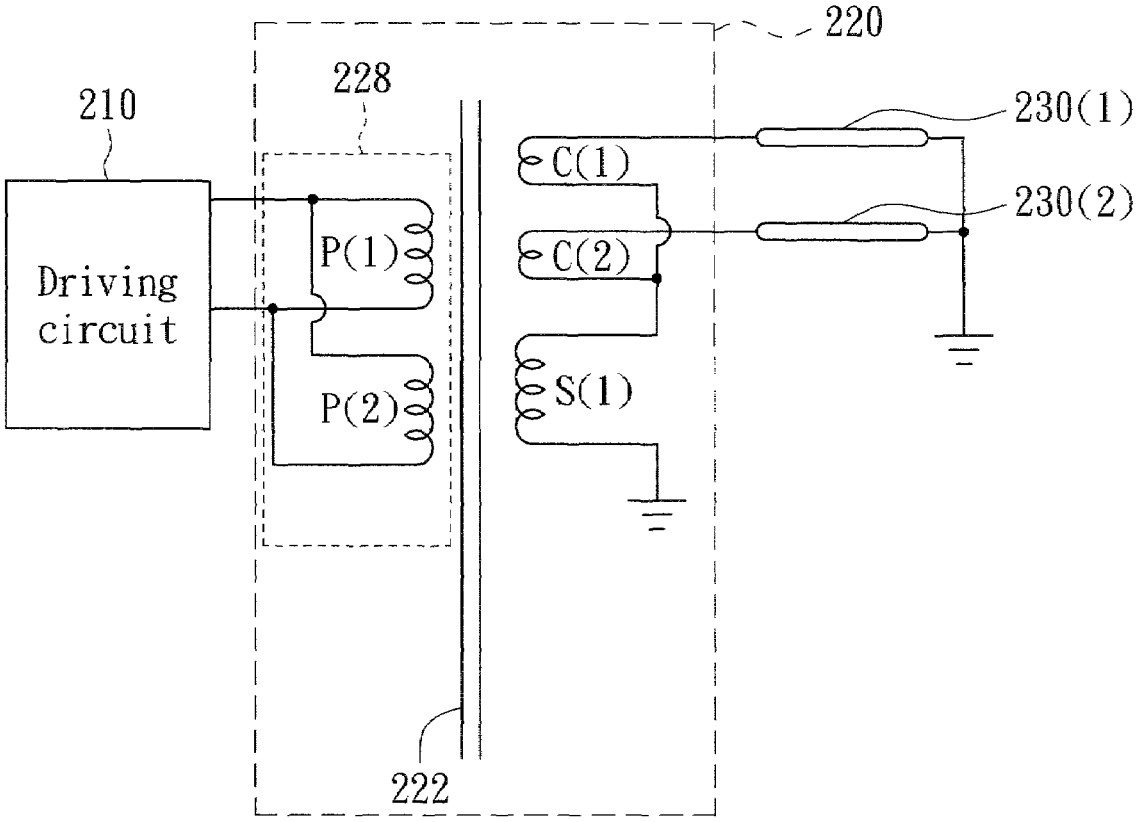
FIG. 23 is a circuit diagram of the backlight module according to the tenth embodiment of the invention.

Referring to both FIG. 22 and FIG. 23. FIG. 22 is a structural diagram of a backlight module according to a tenth embodiment of the invention. FIG. 23 is a circuit diagram of the backlight module according to the tenth embodiment of the invention. For simplification, the primary winding 228 of FIG. 22 and FIG. 23 is exemplified by two primary coils P(1)~P(2), and the secondary winding 229 is exemplified by a secondary coil S(1) and two auxiliary coils C(1)~C(2).

In the tenth embodiment, the primary coils P(1)~P(2) and the secondary coil S(1) wind around the first bobbin 224; the auxiliary coils C(1)~C(2) wind around the second bobbin 226. The primary coils P(1)~P(2) are coupled to the driving circuit 210. The lamps 230(1)~230(2) are coupled to the secondary coil S(1) through the auxiliary coils C(1)~C(2) respectively.

Each of the auxiliary coils C(1)~C(2) has one end respectively coupled to one end of one of the lamps 230(1)~230(2), and the each of the auxiliary coils C(1)~C(2) has the other end coupled to one end of the secondary coil S(1), wherein the secondary coil S(1) has the other end coupled to a grounding end and each of the lamps 230(1)~230(2) has the other end coupled to the grounding end.

Likewise, as the turns of the auxiliary coils C(1)~C(2) are substantially equal and the auxiliary coils C(1)~C(2) correspond to the same magnetic path, the currents flowing through the lamps 230(1)~230(2) are also substantially equal.

Eleventh Embodiment

Figure 24:
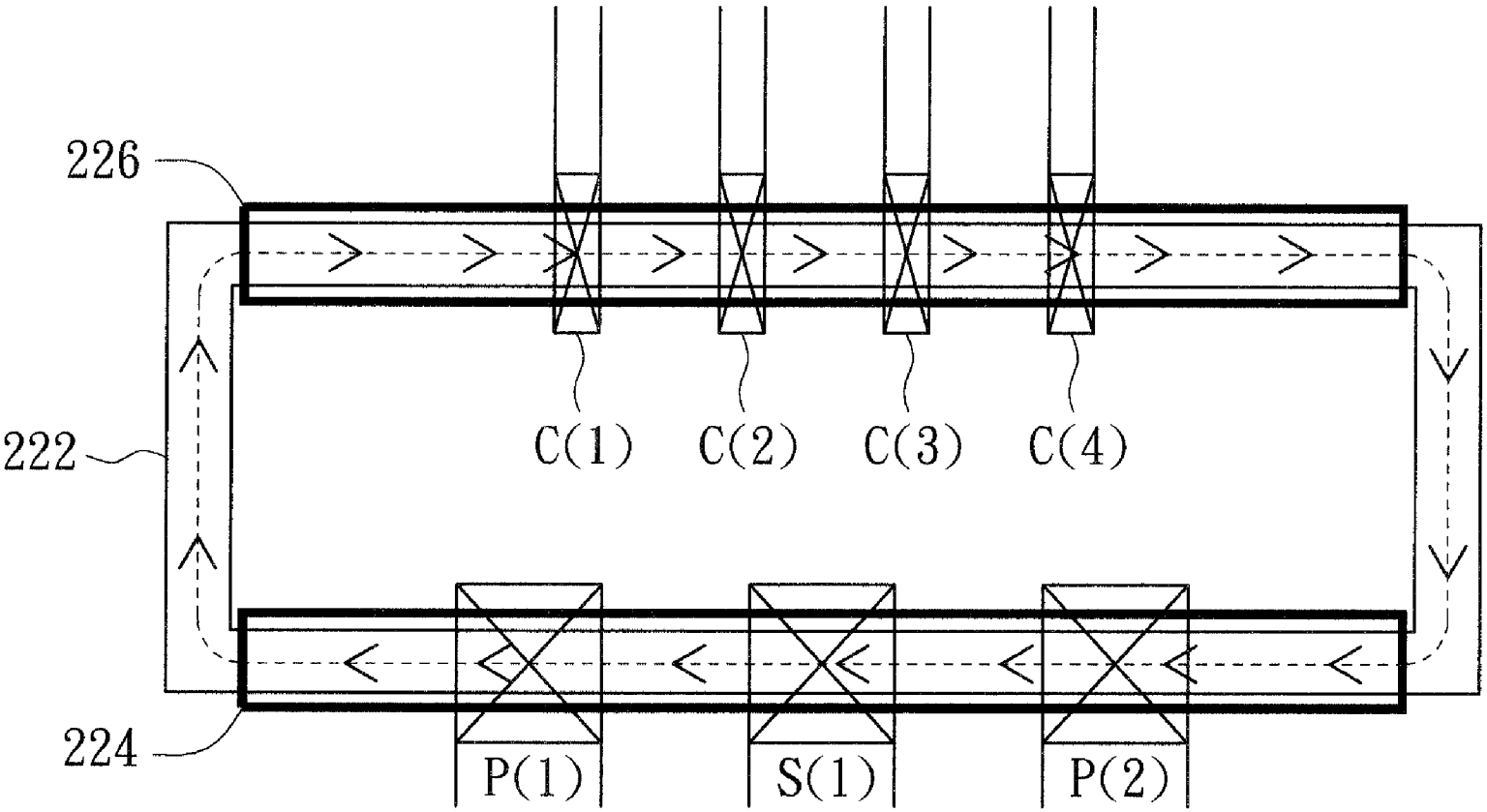
FIG. 24 is a structural diagram of a backlight module according to an eleventh embodiment of the invention.
Figure 25:
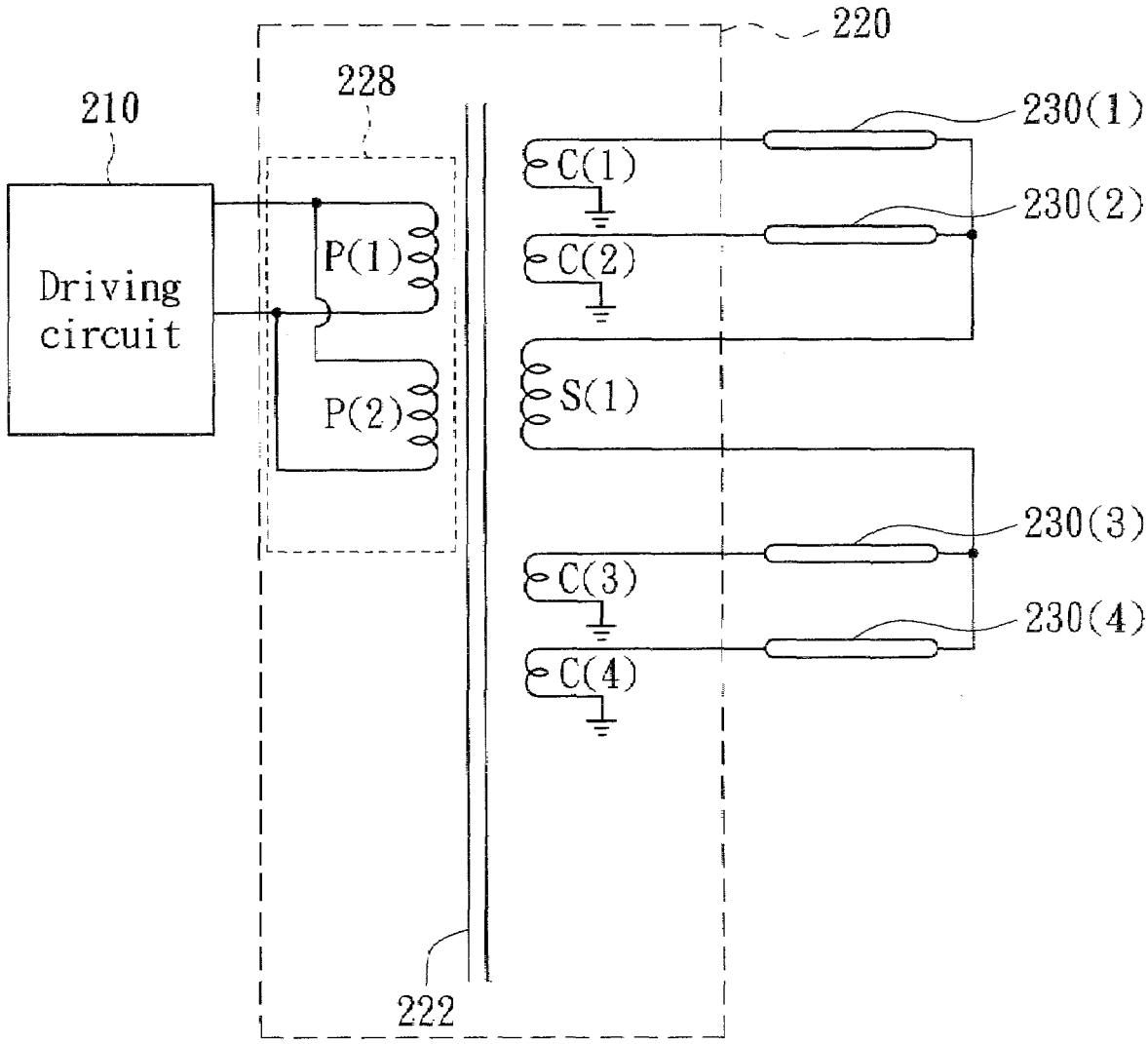
FIG. 25 is a circuit diagram of the backlight module according to the eleventh embodiment of the invention.

Referring to both FIG. 24 and FIG. 25. FIG. 24 is a structural diagram of a backlight module according to an eleventh embodiment of the invention. FIG. 25 is a circuit diagram of the backlight module according to the eleventh embodiment of the invention. For simplification, the primary winding 228 of FIG. 24 and 25 is exemplified by two primary coils P(1)~P(2), and the secondary winding 229 is exemplified by a secondary coil S(1) and four auxiliary coils C(1)~C(4).

In the eleventh embodiment, the primary coils P(1)~P(2) and the secondary coil S(1) wind around the first bobbin 224; the auxiliary coils C(1)~C(4) wind around the second bobbin 226. The primary coils P(1)~P(2) is coupled to the driving circuit 210. The auxiliary coils C(1)~C(4) are coupled to the secondary coil S(1) through the lamps 230(1)~230(4) respectively.

Each of the auxiliary coils C(1)~C(4) has one end coupled to one end of one of the lamps 230(1)~230(4) respectively. Each of the lamps 230(1)~230(2) has the other end coupled to one end of the secondary coil S(1). Each of the lamps 230(3)~230(4) has the other end coupled to the other end of the secondary coil S(1). Each of the auxiliary coils C(1)~C(4) has the other end coupled to a grounding end.

Likewise, as the turns of the auxiliary coils C(1)~C(4) are substantially equal and the auxiliary coils C(1)~C(4) correspond to the same magnetic path, the currents flowing through the lamps 230(1)~230(4) are also substantially equal.

Twelfth Embodiment

Figure 26:
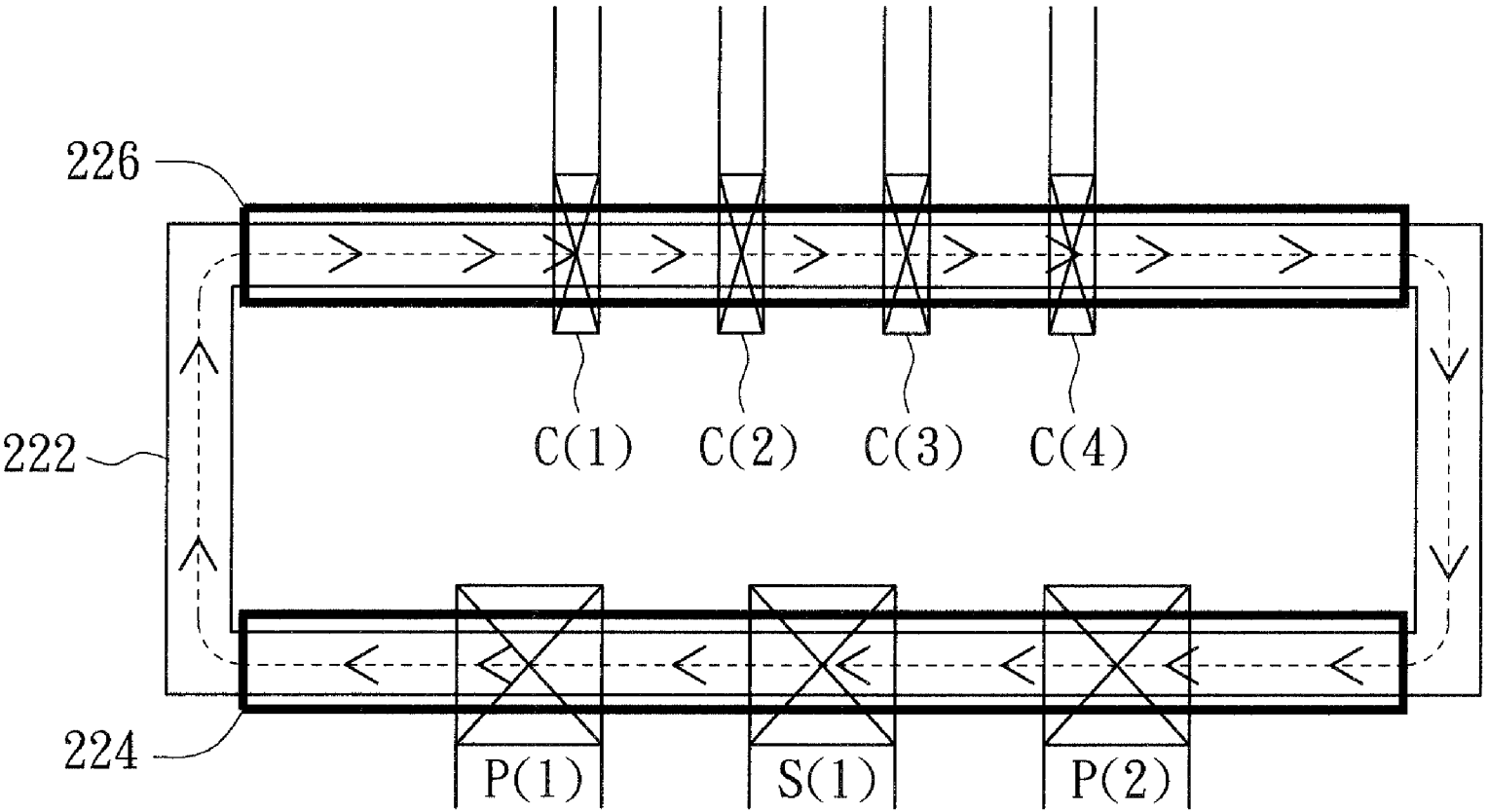
FIG. 26 is a structural diagram of the backlight module according to a twelfth embodiment of the invention.
Figure 27:
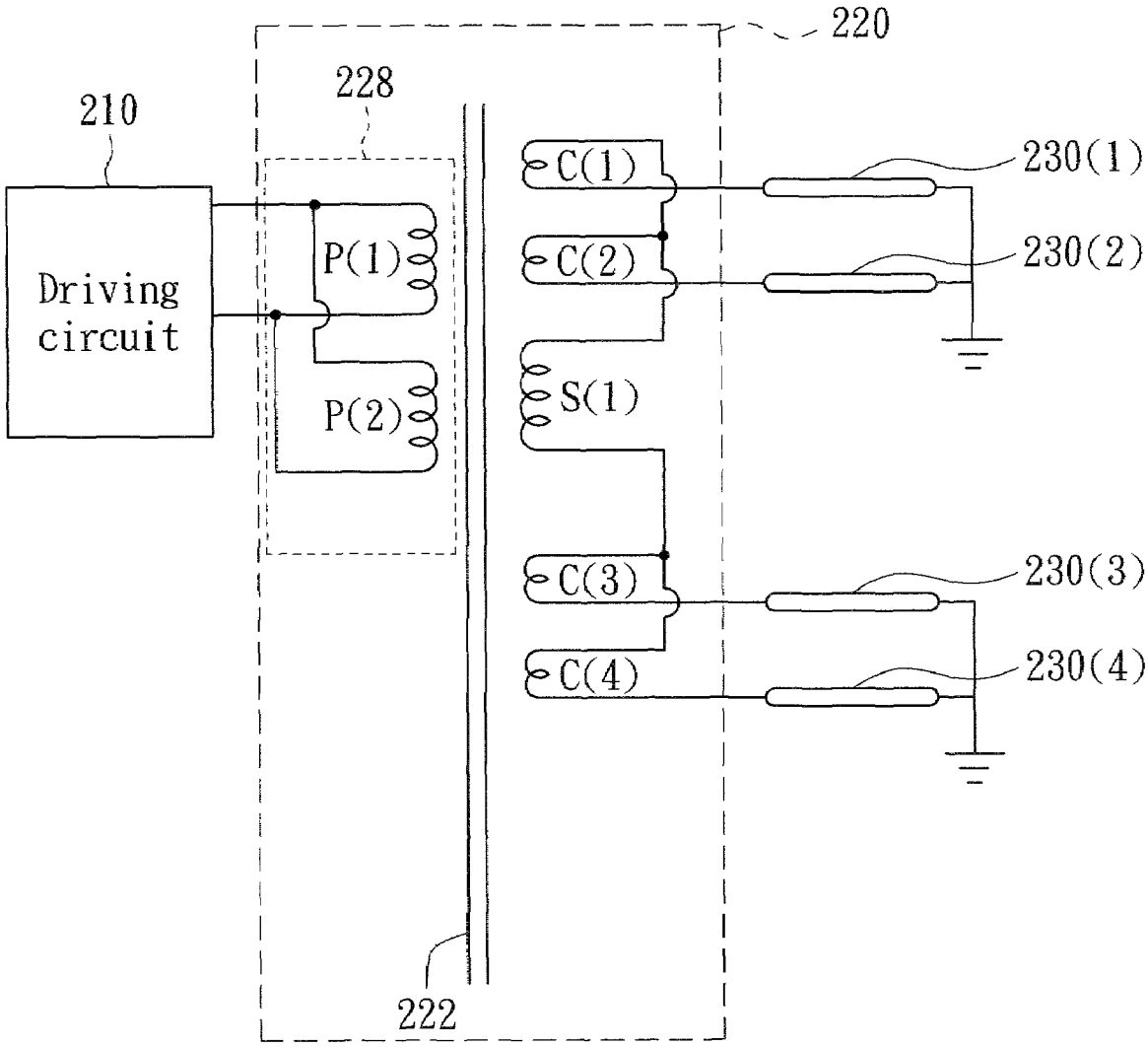
FIG. 27 is a circuit diagram of the backlight module according to the twelfth embodiment of the invention.

Referring to both FIG. 26 and FIG. 27. FIG. 26 is a structural diagram of the backlight module according to a twelfth embodiment of the invention. FIG. 27 is a circuit diagram of the backlight module according to the twelfth embodiment of the invention. For simplification, the primary winding 228 of FIGS. 26 and 27 is exemplified by two primary coils P(1)~P(2), and the secondary winding 229 is exemplified by a secondary coil S(1) and four auxiliary coils C(1)~C(4).

In the twelfth embodiment, the primary coils P(1)~P(2) wind around the first bobbin 224; the secondary coil S(1) and the auxiliary coils C(1)~C(4) wind around the second bobbin 226. The primary winding 228 is coupled to the driving circuit 210. The lamps 230(1)~230(4) are coupled to the secondary coil S(1) through the auxiliary coils C(1)~C(4) respectively.

Each of the auxiliary coils C(1)~C(4) has one end coupled to one end of one of the lamps 230(1)~230(4) respectively. Each of the lamps 230(1)~230(4) has the other end coupled to a grounding end.

Each of the auxiliary coils C(1)~C(2) has the other end coupled to one end of the secondary coil S(1). Each of the auxiliary coils C(3)~C(4) has the other end coupled to the other end of the secondary coil S(1).

Likewise, as the turns of the auxiliary coils C(1)~C(4) are substantially equal and the auxiliary coils C(1)~C(4) correspond to the same magnetic path, the currents flowing through the lamps 230(1)~230(4) are also substantially equal.

Other Dispositions of the Primary Winding and the Secondary Winding

In addition to the first to the twelfth embodiment, the coil of the primary winding and the secondary winding can selectively wind around the first bobbin 224 or the second bobbin 226 in different ways of disposition according to the needs of the design.

Figure 28:
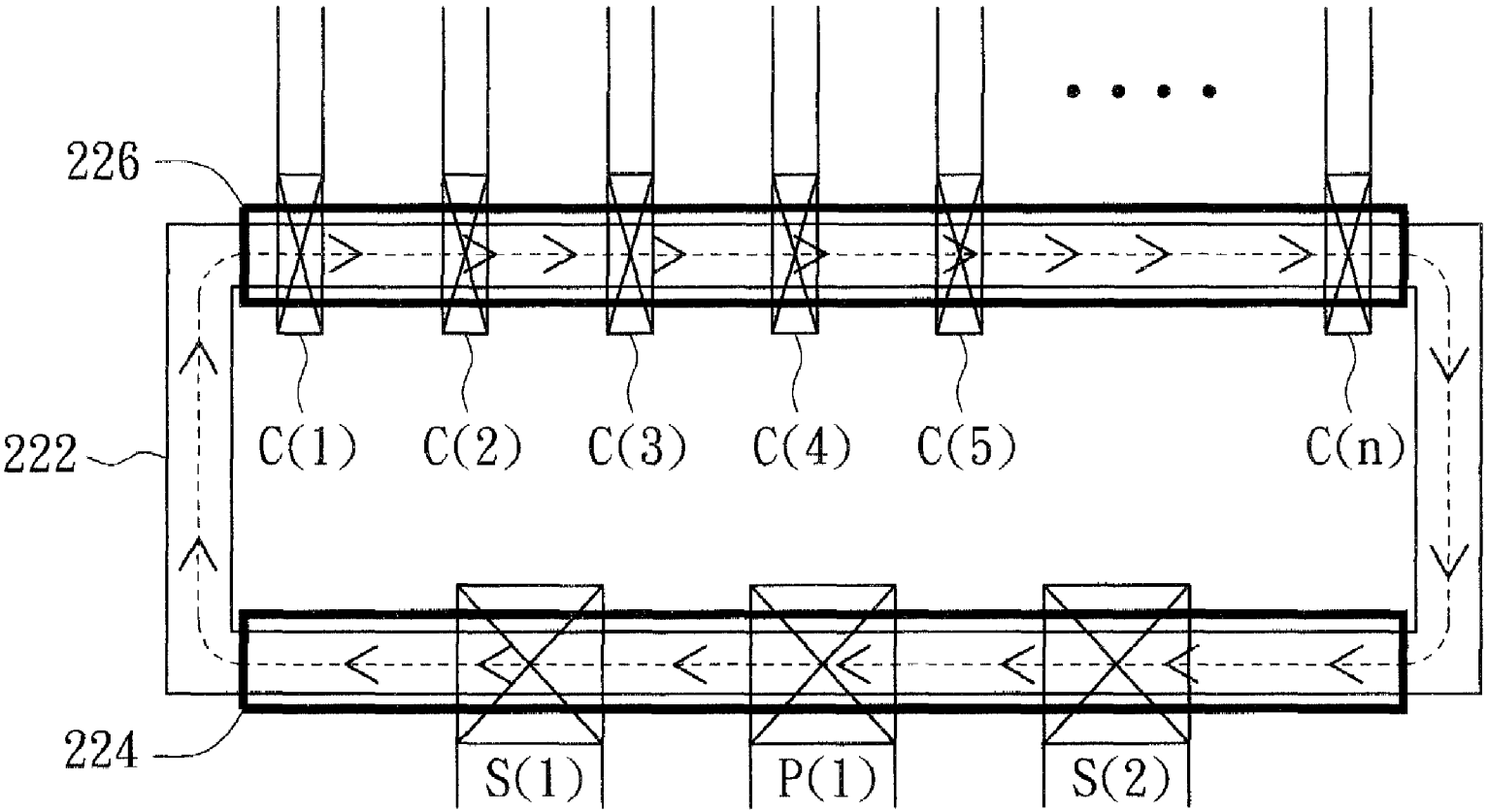
FIG. 28 is another disposition of the primary winding and the secondary winding.

Referring to FIG. 28, another disposition of the primary winding and the secondary winding is shown. For simplification, the primary winding 228 of FIG. 28 is exemplified by a primary coil P(1), and the secondary winding 229 is exemplified by two secondary coils S(1)~S(2) and n auxiliary coils C(1)~C(n), wherein n is a positive integer not equal to 0.

The primary coil P(1), the secondary coils S(1)~S(2) are disposed on the first bobbin 224 and sequentially wind the secondary coil S(1), the primary coil P(1) and the secondary coil S(2) from left to right. The auxiliary coils C(1)~C(n) are disposed on the second bobbin 226 and sequentially wind auxiliary coils C(1) and the auxiliary coils C(2)~C(n) from left to right.

Figure 29:
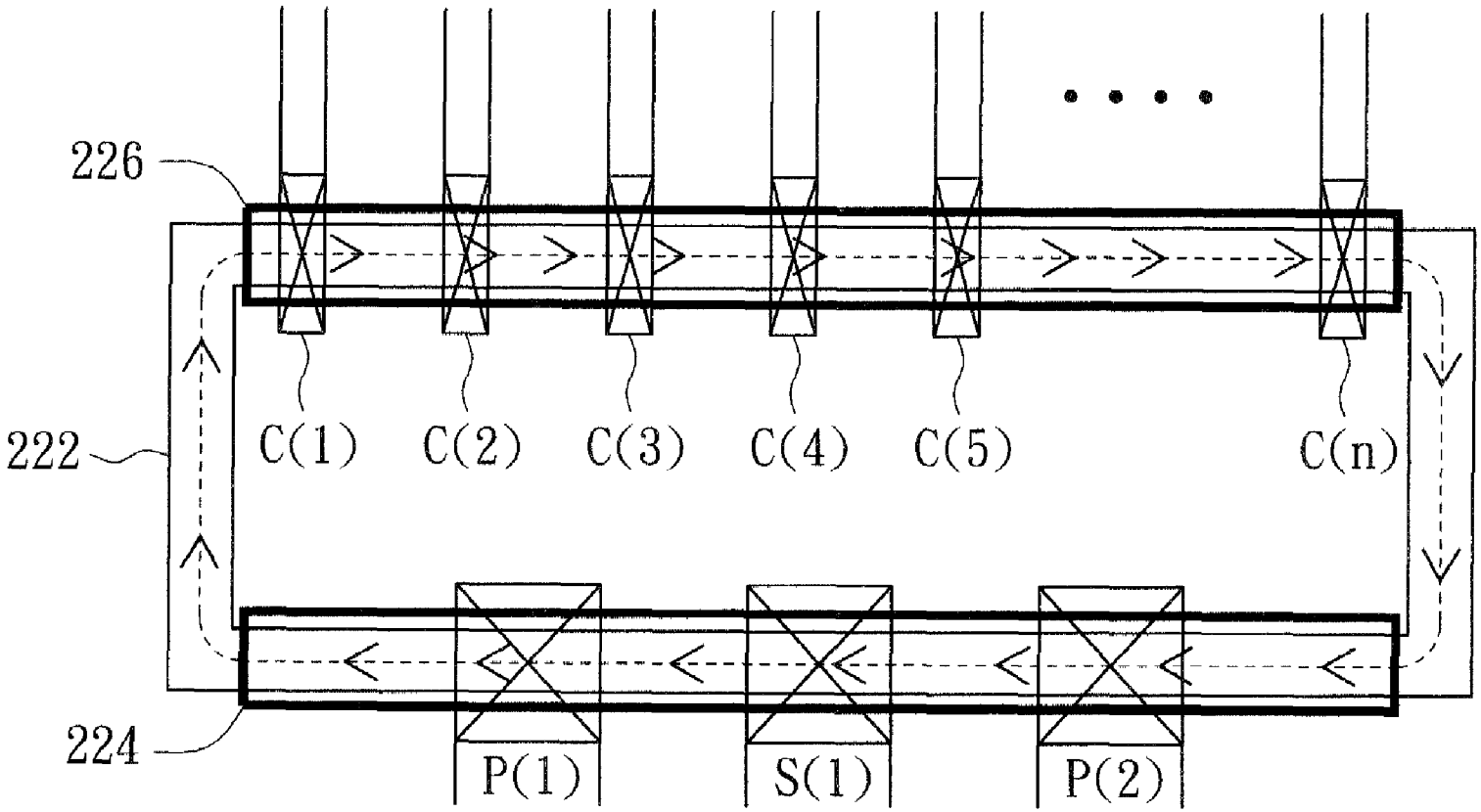
FIG. 29 is another disposition of the primary winding and the secondary winding.

Referring to FIG. 29, another disposition of the primary winding and the secondary winding is shown. For simplification, the primary winding 228 of FIG. 29 is exemplified by two primary coils P(1)~P(2), and the secondary winding 229 is exemplified by a secondary coil S(1) and the auxiliary coils C(1)~C(n), wherein n is a positive integer not equal to 0.

The primary coils P(1)~P(2) and the secondary coil S(1) are disposed on the first bobbin 224 and sequentially wind the primary coil P(1), the secondary coil S(1) and the primary coil P(2) from left to right. The auxiliary coils C(1)~C(n) are disposed on the second bobbin 226 and sequentially wind auxiliary coils C(1) and the auxiliary coils C(2)~C(n) from left to right.

Figure 30:
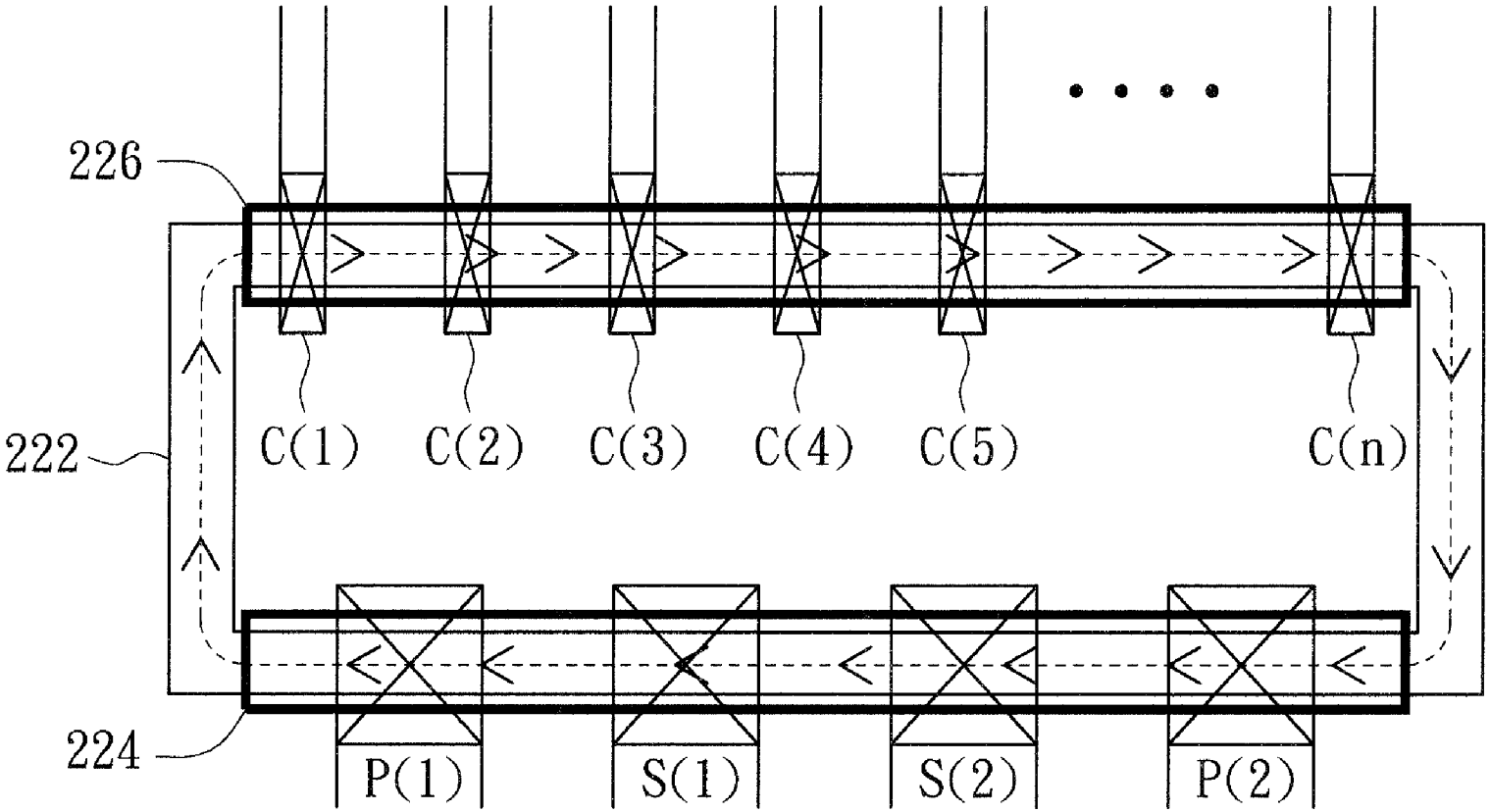
FIG. 30 is another disposition of the primary winding and the secondary winding.

Referring to FIG. 30, another disposition of the primary winding and the secondary winding is shown. For simplification, the primary winding 228 of FIG. 30 is exemplified by two primary coils P(1)~P(2), and the secondary winding 229 is exemplified by two secondary coils S(1)~S(2) and n auxiliary coils C(1)~C(n), wherein n is a positive integer not equal to 0.

The primary coil P(1), the primary coil P(2), the secondary coils S(1)~S(2) are disposed on the first bobbin 224 and sequentially wind the primary coil P(1), the secondary coil S(1), the secondary coil S(1) and the primary coil P(2) from left to right. The auxiliary coils C(1)~C(n) are disposed on the second bobbin 226 and sequentially wind auxiliary coils C(1) and the auxiliary coils C(2)~C(n) from left to right.

Figure 31:
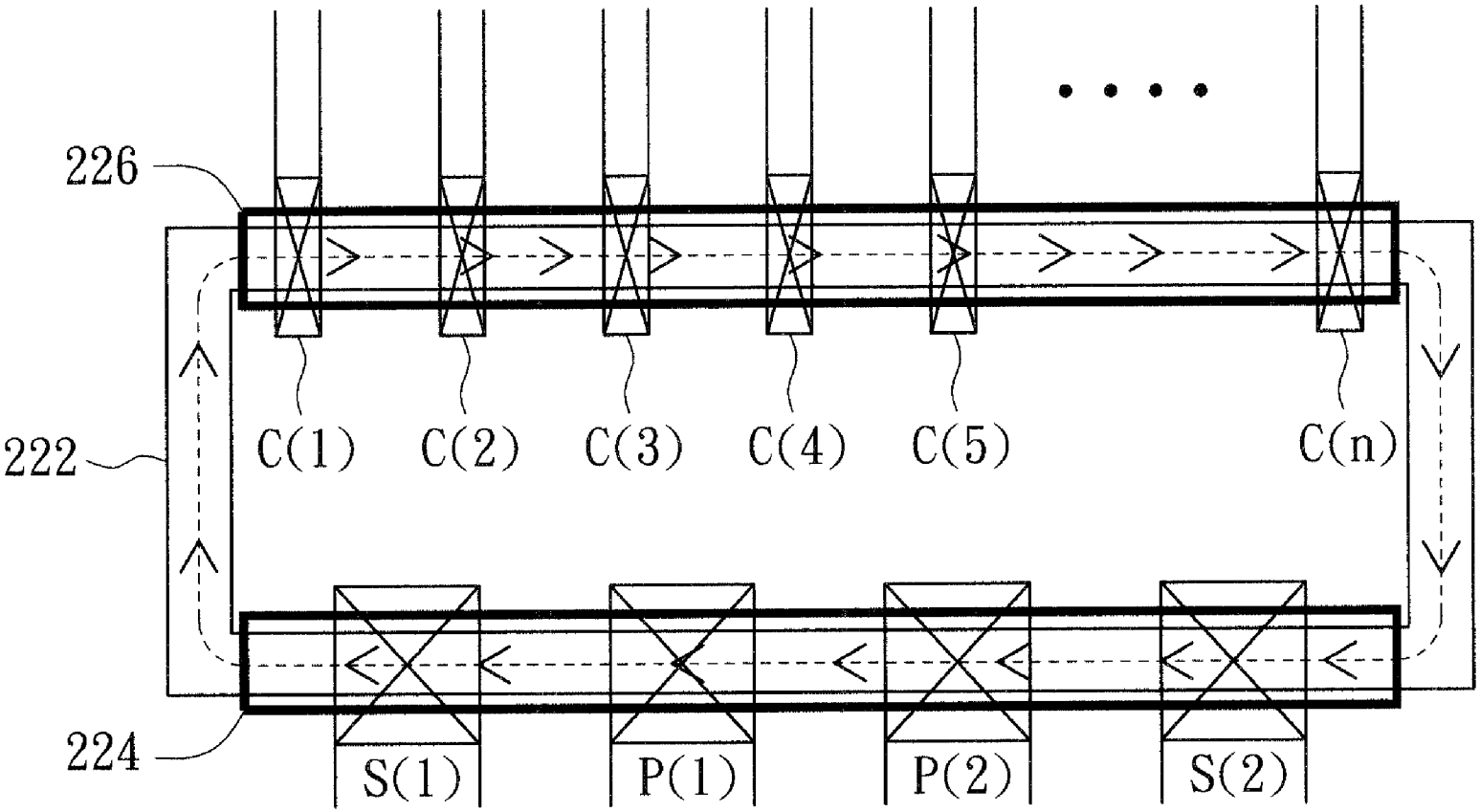
FIG. 31 is another disposition of the primary winding and the secondary winding.

Referring to FIG. 31, another disposition of the primary winding and the secondary winding is shown. For simplification, the primary winding 228 of FIG. 31 is exemplified by two primary coils P(1)~P(2), and the secondary winding 229 is exemplified by two secondary coils S(1)~S(2) and n auxiliary coils C(1)~C(n), wherein n is a positive integer not equal to 0.

The primary coil P(1), the primary coil P(2), the secondary coils S(1)~S(2) are disposed on the first bobbin 224 and sequentially wind the secondary coil S(1), the primary coils P(1)~P(2) and the secondary coil S(1) from left to right. The auxiliary coils C(1)~C(n) are disposed on the second bobbin 226 and sequentially wind auxiliary coils C(1) and the auxiliary coils C(2)~C(n) from left to right.

Figure 32:
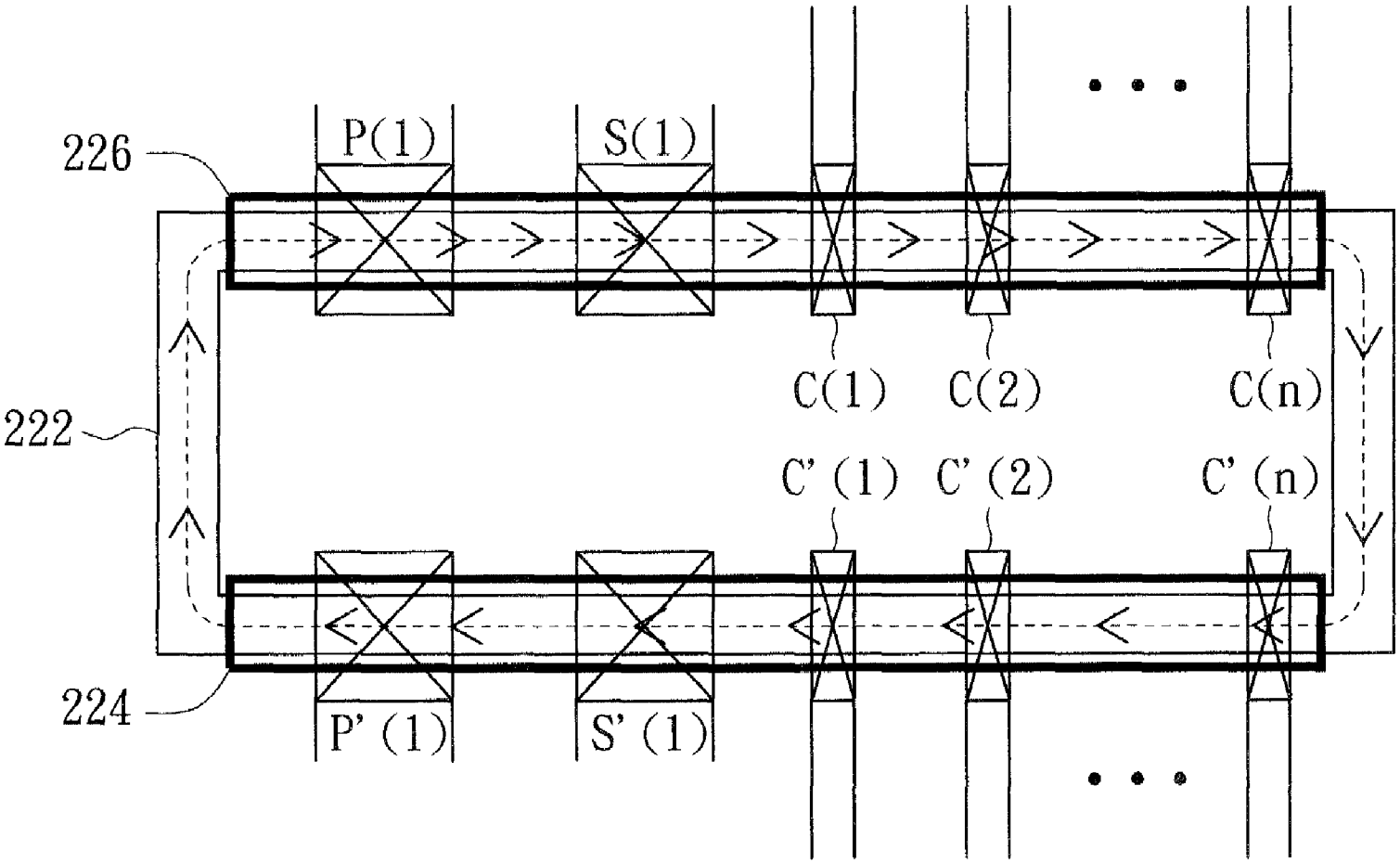
FIG. 32 is another disposition of the primary winding and the secondary winding.

Referring to FIG. 32, another disposition of the primary winding and the secondary winding is shown. For simplification, FIG. 32 the primary winding 228 of is exemplified by two primary coils P(1) and P'(1), and the secondary winding 229 is exemplified by a secondary coil S(1), a secondary coil S'(1), n auxiliary coils C(1)~C(n) and n auxiliary coils C'(1)~C'(n), wherein n is a positive integer not equal to 0.

The primary coil P'(1), the secondary coil S'(1) and the auxiliary coils C'(1)~C'(n) are disposed on the first bobbin 224 and sequentially wind the primary coil P'(1), the secondary coil S'(1) and the auxiliary coils C'(1)~C'(n) from left to right. The primary coil P(1), the secondary coil S(1) and the auxiliary coils C(1)~C(n) are disposed on the second bobbin 226 and sequentially wind the primary coil P(1), the secondary coil S(1) and the auxiliary coils C(1)~C(n) from left to right.

Figure 33:
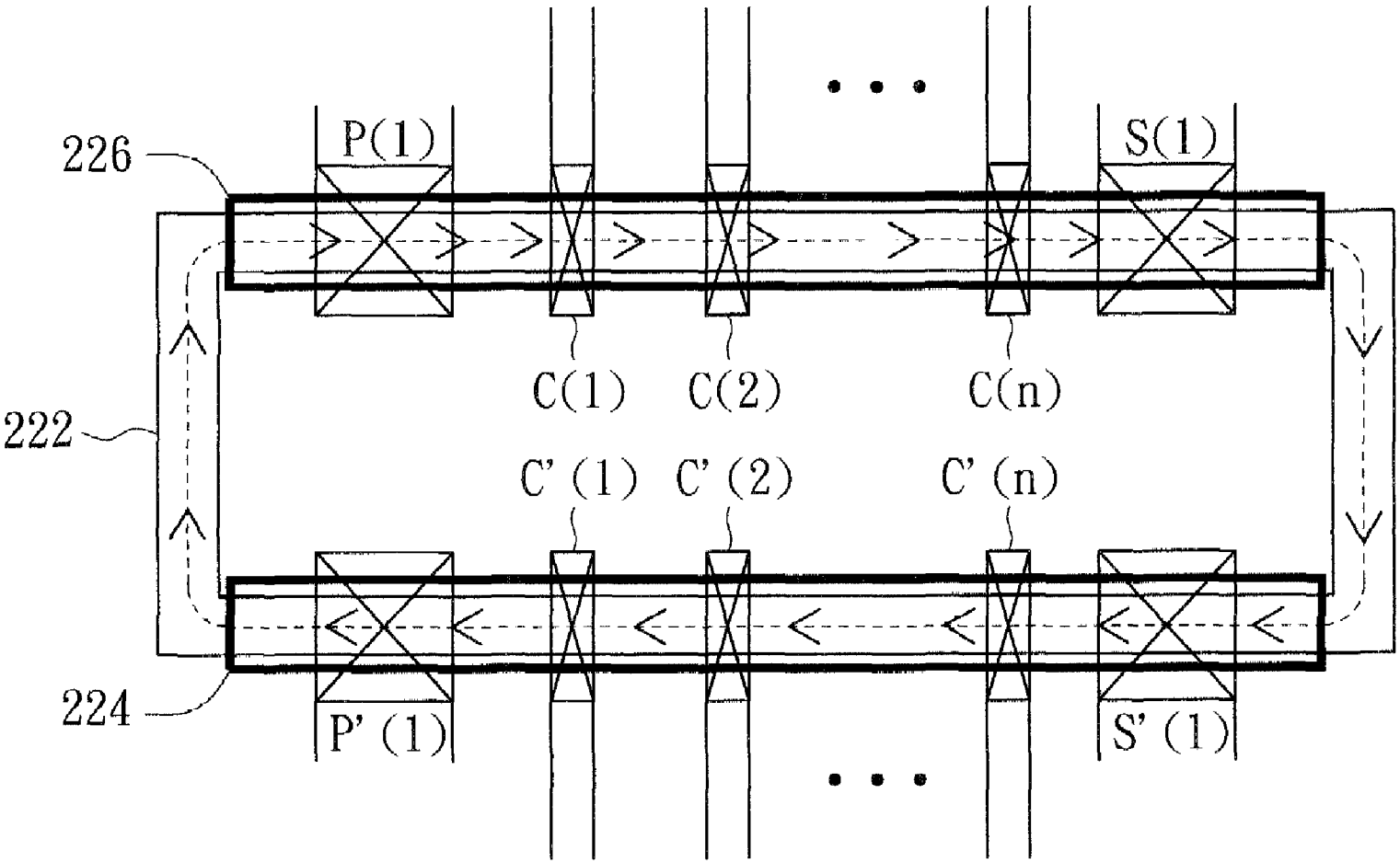
FIG. 33 is another disposition of the primary winding and the secondary winding.

Referring to FIG. 33, another disposition of the primary winding and the secondary winding is shown. For simplification, the primary winding 228 of FIG. 33 is exemplified by two primary coils P(1) and P'(1), and the secondary winding 229 is exemplified by a secondary coil S(1), a secondary coil S'(1), n auxiliary coils C(1)~C(n) and n auxiliary coils C'(1)~C'(n), wherein n is a positive integer not equal to 0.

The primary coil P'(1), the secondary coil S'(1) and the auxiliary coils C'(1)~C'(n) are disposed on the first bobbin 224 and sequentially wind the primary coil P'(1), the auxiliary coils C'(1), the auxiliary coils C'(2)~C'(n) and the secondary coil S'(1) from left to right. The primary coil P(1), the secondary coil S(1) and the auxiliary coils C(1)~C(n) are disposed on the second bobbin 226 and sequentially wind the primary coil P(1), the auxiliary coils C(1), the auxiliary coils C(2)~C(n) and the secondary coil S(1) from left to right.

Figure 34:
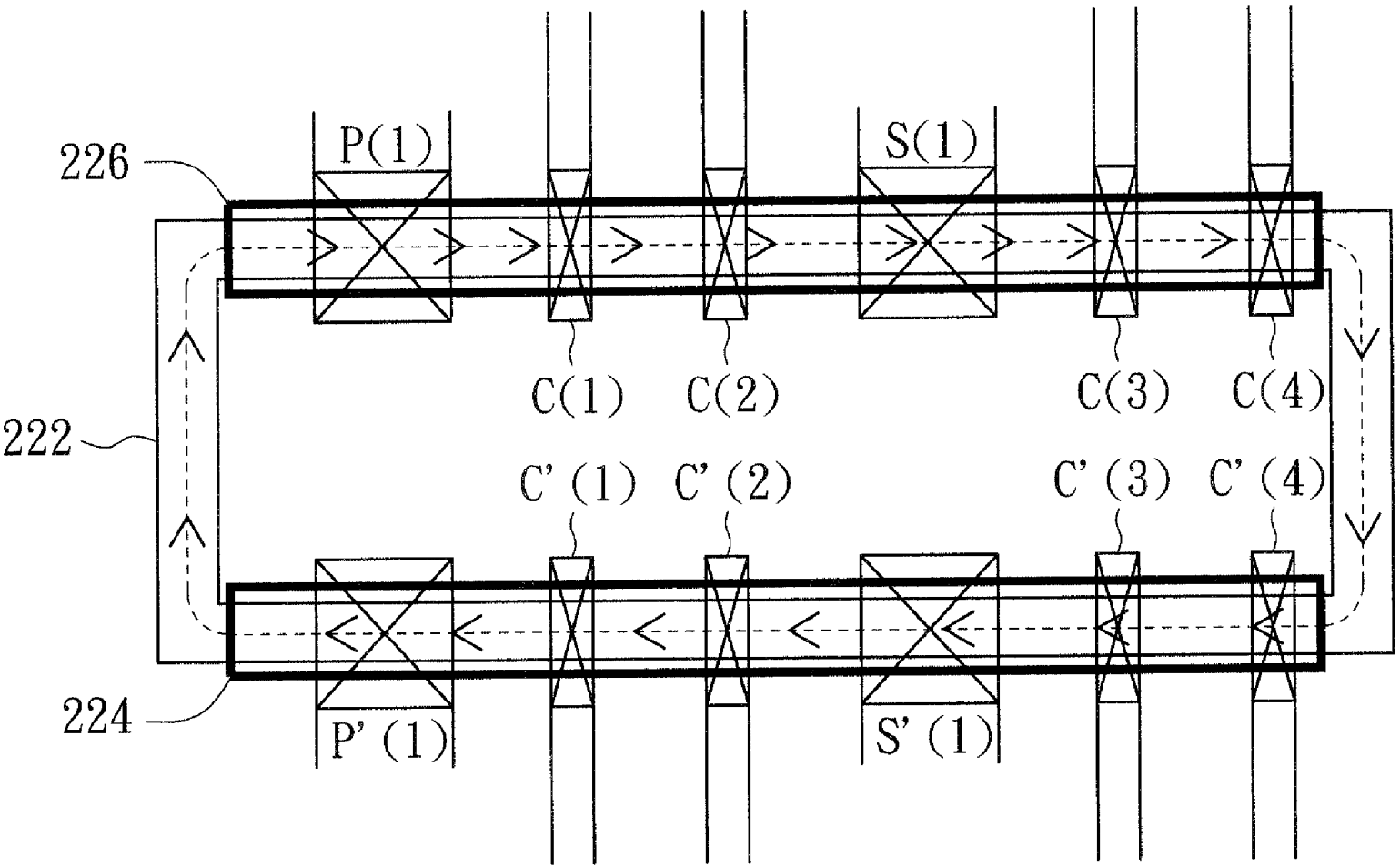
FIG. 34 is another disposition of the primary winding and the secondary winding.

Referring to FIG. 34, another disposition of the primary winding and the secondary winding is shown. For simplification, the primary winding 228 of FIG. 34 is exemplified by two primary coils P(1) and P'(1), and the secondary winding 229 is exemplified by a secondary coil S(1), a secondary coil S'(1), four auxiliary coils C(1)~C(4) and four auxiliary coils C'(1)~C'(4).

The primary coil P'(1), the secondary coil S'(1) and the auxiliary coils C'(1)~C'(4) are disposed on the first bobbin 224 and sequentially wind the primary coil P'(1), the auxiliary coils C'(1), the auxiliary coils C'(2), the secondary coil S'(1), the auxiliary coils C'(3) and the auxiliary coils C'(4) from left to right. The primary coil P(1), the secondary coil S(1) and the auxiliary coils C(1)~C(4) are disposed on the second bobbin 226 and sequentially wind the primary coil P(1), the auxiliary coils C(1), the auxiliary coils C(2), the secondary coil S(1), the auxiliary coils C(3) and the auxiliary coils C(4) from left to right.

Figure 35:
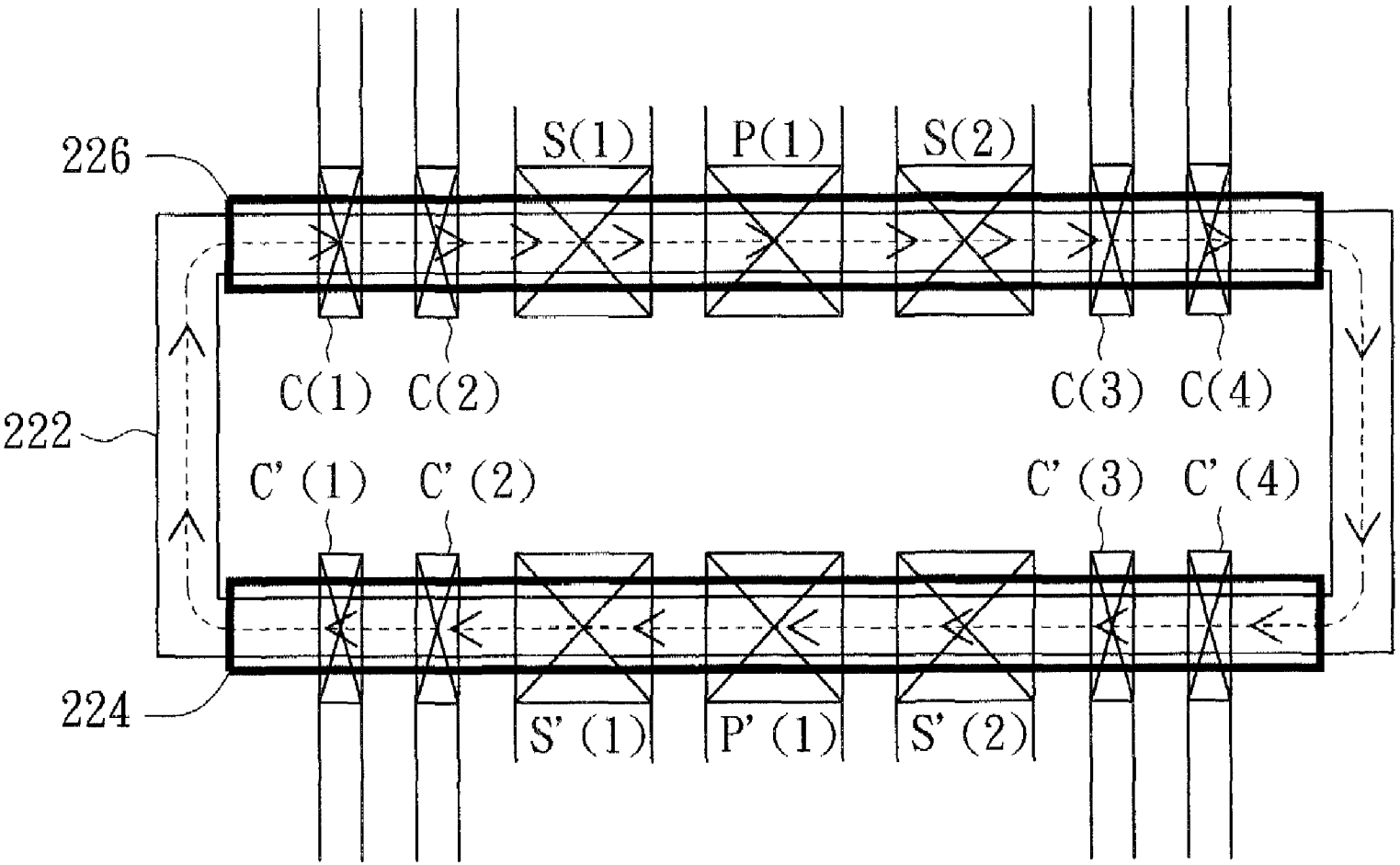
FIG. 35 is another disposition of the primary winding and the secondary winding.

Referring to FIG. 35, another disposition of the primary winding and the secondary winding is shown. For simplification, the primary winding 228 of FIG. 35 a primary coil P(1) and a primary coil P'(1), and the secondary winding 229 is exemplified by a secondary coil S(1), a secondary coil S'(1), a secondary coil S(2), a secondary coil S'(2), four auxiliary coils C(1)~C(4) and four auxiliary coils C'(1)~C'(4).

The primary coil P'(1), the secondary coil S'(1), the secondary coil S'(2) and the auxiliary coils C'(1)~C'(4) are disposed on the first bobbin 224 and sequentially wind auxiliary coils C'(1), the auxiliary coils C'(2), the secondary coil S'(1), the primary coil P'(1), the secondary coil S'(2), the auxiliary coils C'(3), the auxiliary coils C'(4) from left to right. The primary coil P(1), the secondary coil S(1), the secondary coil S(2) and the auxiliary coils C(1)~C(4) are disposed on the second bobbin 226 and sequentially wind auxiliary coils C(1), the auxiliary coils C(2), the secondary coil S(1), the primary coil P(1), the secondary coil S(2), the auxiliary coils C(3), the auxiliary coils C(4) from left to right.

Figure 36:
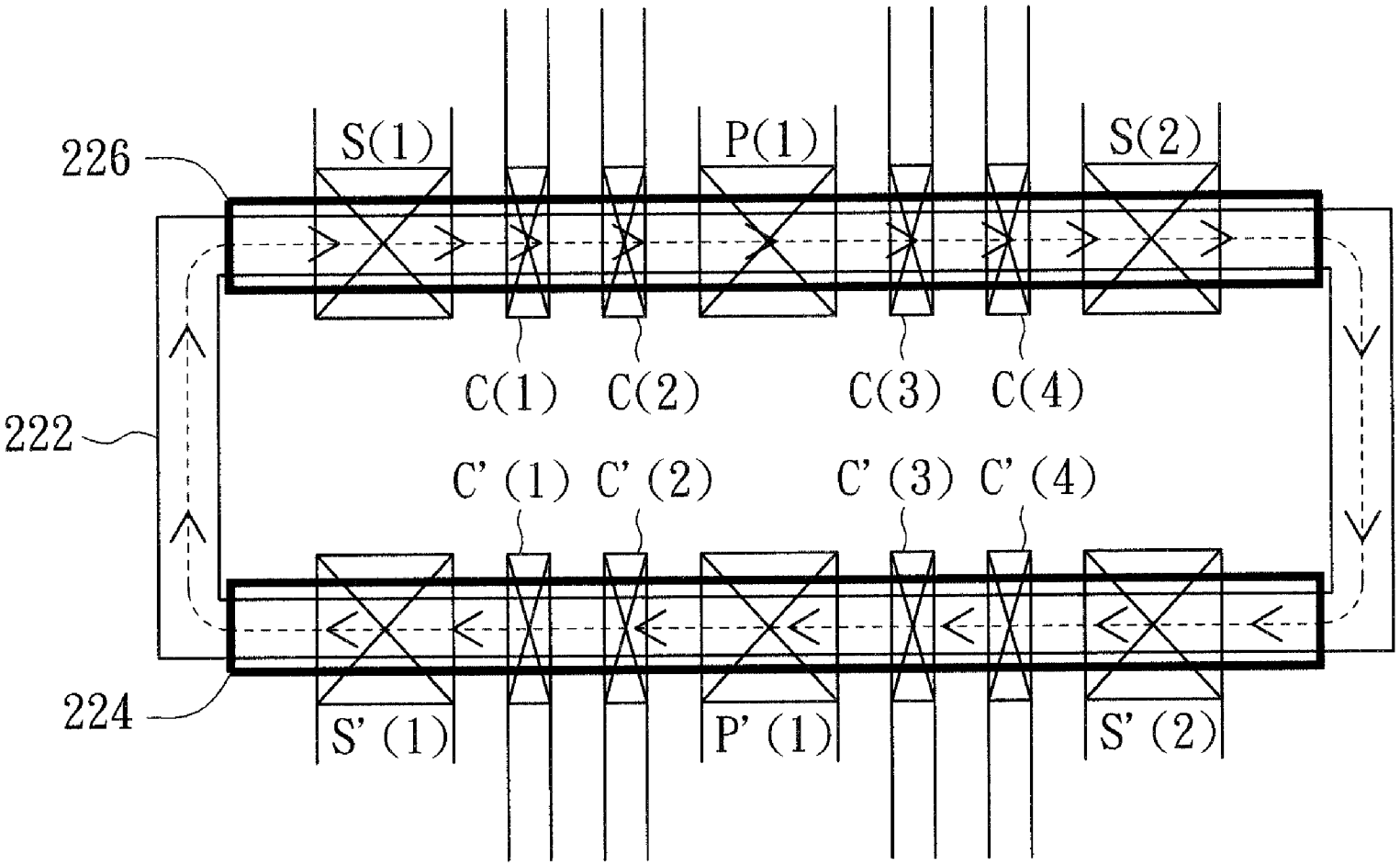
FIG. 36 is another disposition of the primary winding and the secondary winding.

Referring to FIG. 36, another disposition of the primary winding and the secondary winding is shown. For simplification, the primary winding 228 of FIG. 36 is exemplified by two primary coils P(1) and P'(1), and the secondary winding 229 is exemplified by a secondary coil S(1), a secondary coil S'(1), a secondary coil S(2), a secondary coil S'(2), four auxiliary coils C(1)~C(4) and four auxiliary coils C'(1)~C'(4).

The primary coil P'(1), the secondary coil S'(1), the secondary coil S'(2) and the auxiliary coils C'(1)~C'(4) are disposed on the first bobbin 224 and sequentially wind the secondary coil S'(1), the auxiliary coils C'(1), the auxiliary coils C'(2), the primary coil P'(1), the auxiliary coils C'(3), the auxiliary coils C'(4) and the secondary coil S'(2) from left to right. The primary coil P(1), the secondary coil S(1), the secondary coil S(2) and the auxiliary coils C(1)~C(4) are disposed on the second bobbin 226 and sequentially wind the secondary coil S(1), the auxiliary coils C(1), the auxiliary coils C(2), the primary coil P(1), the auxiliary coils C(3), the auxiliary coils C(4) and the secondary coil S(2) from left to right.

Figure 37:
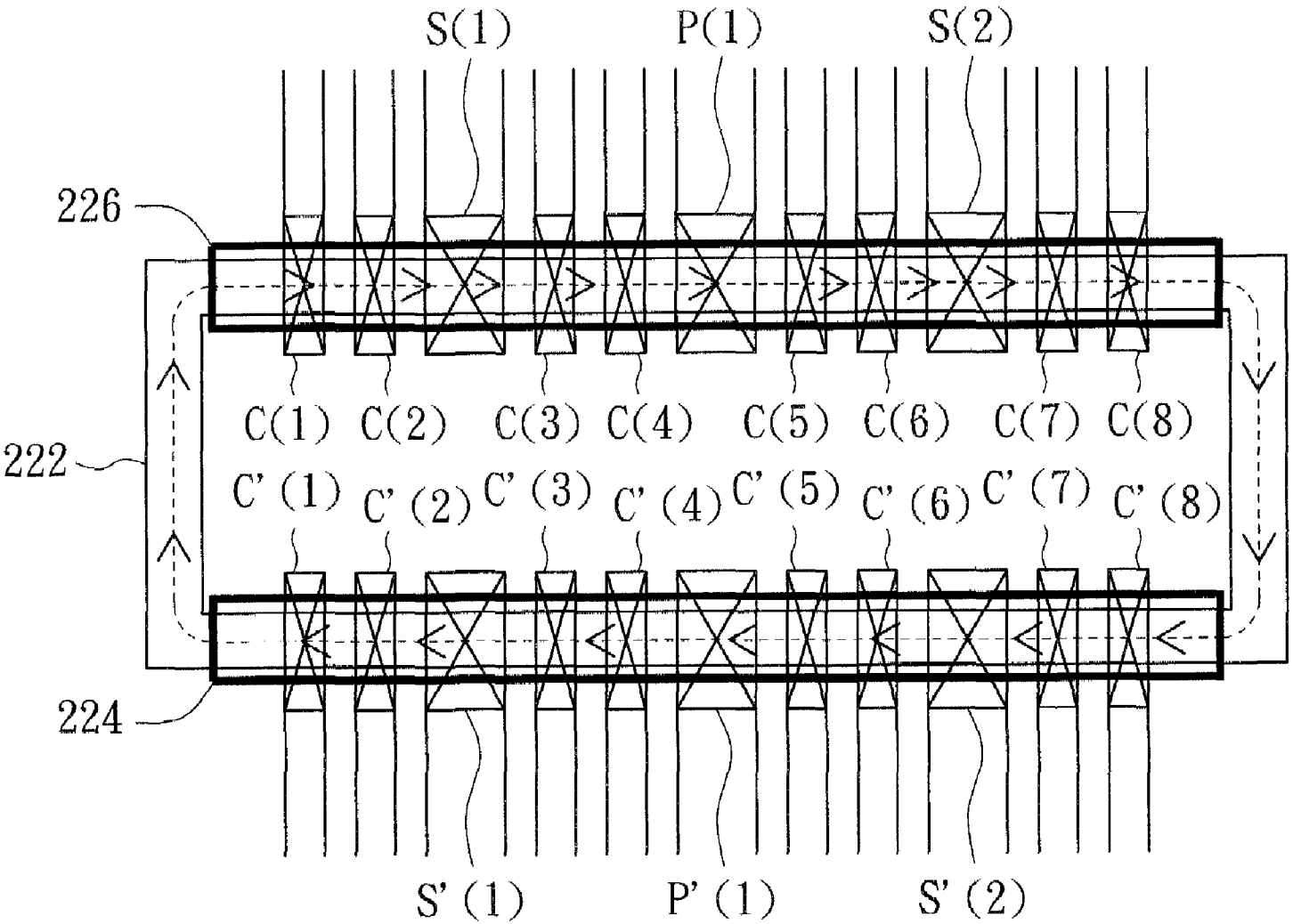
FIG. 37 is another disposition of the primary winding and the secondary winding.

Referring to FIG. 37, another disposition of the primary winding and the secondary winding is shown. For simplification, the primary winding 228 of FIG. 37 is exemplified by two primary coil P(1) and P'(1), and the secondary winding 229 is exemplified by a secondary coil S(1), a secondary coil S'(1), a secondary coil S(2), a secondary coil S'(2), eight auxiliary coils C(1)~C(8) and eight auxiliary coils C'(1)~C'(8).

The primary coil P'(1), the secondary coil S'(1), the secondary coil S'(2) and the auxiliary coils C'(1)~C'(8) are disposed on the first bobbin 224 and sequentially wind auxiliary coils C'(1), the auxiliary coils C'(2), the secondary coil S'(1), the auxiliary coils C'(3), the auxiliary coils C'(4), the primary coil P'(1), the auxiliary coils C'(5), the auxiliary coils C'(6), the secondary coil S'(2), the auxiliary coils C'(7) and the auxiliary coils C'(8) from left to right. The primary coil P(1), the secondary coil S(1), the secondary coil S(2) and the auxiliary coils C(1)~C(8) are disposed on the second bobbin 226 and sequentially wind auxiliary coils C(1), the auxiliary coils C(2), the secondary coil S(1), the auxiliary coils C(3), the auxiliary coils C(4), the primary coil P(1), the auxiliary coils C(5), the auxiliary coils C(6), the secondary coil S(2), the auxiliary coils C(7) and the auxiliary coils C(8) from left to right.

According to the above disclosure, the secondary coils and the auxiliary coils can flexibly and selectively wind the first bobbin or the second bobbin so as to reduce the volume of the transformer. As the turns of the auxiliary coils of the transformer are substantially equal, the backlight module is able to balance the currents of the lamps, hence improving the derived problems when driving conventional multi-lamps.

According to the transformer and the backlight module thereof disclosed in the above embodiments of the invention, the turns of the auxiliary coils are substantially equal, so the currents of the lamps are balanced, not only making the luminance of the display image more uniformed but also prolonging the lifespan of the lamps. Besides, as the primary coil, the secondary coil and the auxiliary coils can be selectively disposed on the first bobbin and the second bobbin at the two sides of the core according to the design, the transformer has an even smaller volume and a thinner size to enhance the market competiveness.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A transformer for driving multi-lamps, comprising:
- a primary winding, comprising:
  - a first primary coil;
- a secondary winding, comprising:
  - a first secondary coil; and
  - a plurality of auxiliary coils whose turns are substantially equal;
- a core having a first side and a second side; and
- a first bobbin and a second bobbin respectively disposed on the first side and the second side for winding around the first primary coil, the first secondary coil and the auxiliary coils.

2. The transformer according to claim 1, wherein the first primary coil winds around the first bobbin, and the first secondary coil and the auxiliary coils wind around the second bobbin.

3. The transformer according to claim 2, wherein the secondary winding further comprises a second secondary coil winding around the second bobbin.

4. The transformer according to claim 3, wherein the primary winding further comprises a second primary coil winding around the first bobbin.

5. The transformer according to claim 1, wherein the first primary coil and the first secondary coil wind around the first bobbin, and the auxiliary coils winds around the second bobbin.

6. The transformer according to claim 5, wherein the secondary winding further comprises a second secondary coil winding around the first bobbin.

7. The transformer according to claim 6, wherein the primary winding further comprises a second primary coil winding around the first bobbin.

8. The transformer according to claim 1, wherein the secondary winding further comprises a second secondary coil, the primary winding further comprises a second primary coil, the first primary coil and the first secondary coil wind around the first bobbin, the second primary coil and the second secondary coil wind around the second bobbin, and the auxiliary coils wind around the first bobbin and the second bobbin respectively.

9. The transformer according to claim 1, wherein the first secondary coil are coupled to a plurality of lamps through the auxiliary coils.

10. The transformer according to claim 1, wherein the first secondary coil is coupled to a plurality of lamps and is further coupled to the auxiliary coils through the lamps.

11. A backlight module, comprising:
- a plurality of lamps;
- a driving circuit; and
- a transformer, comprising:
  - a primary winding, comprising:
    - a first primary coil coupled to the driving circuit;
  - a secondary winding, comprising:
    - a first secondary coil; and
    - a plurality of auxiliary coils through which the lamps are coupled to the first secondary coil respectively, wherein the turns of the auxiliary coils are substantially equal, so that the currents flowing through the lamps are also substantially equal;
  - a core having a first side and a second side; and
  - a first bobbin and a second bobbin respectively disposed on the first side and the second side for winding around the first primary coil, the first secondary coil and the auxiliary coils.

12. The backlight module according to claim 11, wherein each of the auxiliary coils has one end coupled to one end of one of the lamps respectively, each of the lamps has the other end coupled to a grounding end, and the each of the auxiliary coils has the other end coupled to the first secondary coil respectively.

13. The backlight module according to claim 11, wherein each of the auxiliary coils has one end coupled to one end of one of the lamps respectively, each of the auxiliary coils has the other end coupled to one end of the first secondary coil, each of the lamps has the other end coupled to a grounding end, and the first secondary coil has the other end coupled to the grounding end.

14. The backlight module according to claim 11, wherein the first primary coil winds around the first bobbin, and the first secondary coil and the auxiliary coils wind around the second bobbin.

15. The backlight module according to claim 14, wherein the secondary winding further comprises a second secondary coil winding around the second bobbin.

16. The backlight module according to claim 15, wherein the primary winding further comprises a second primary coil winding around the first bobbin.

17. The backlight module according to claim 11, wherein the first primary coil and the first secondary coil wind around the first bobbin, and the auxiliary coils wind around the second bobbin.

18. The backlight module according to claim 17, wherein the secondary winding further comprises a second secondary coil winding around the first bobbin.

19. The backlight module according to claim 18, wherein the primary winding further comprises a second primary coil winding around the first bobbin.

20. The backlight module according to claim 11, wherein the secondary winding further comprises a second secondary coil, the primary winding further comprises a second primary coil, the first primary coil and the first secondary coil wind around the first bobbin, the second primary coil and the second secondary coil wind around the second bobbin, and the auxiliary coils wind around the first bobbin and the second bobbin respectively.

21. A backlight module, comprising:

a plurality of lamps;

a driving circuit; and a transformer, comprising:

a primary winding, comprising:

a first primary coil coupled to the driving circuit;

a secondary winding, comprising:

a first secondary coil; and a plurality of auxiliary coils coupled to the first secondary coil through the lamps respectively, the turns of the auxiliary coils are substantially equal, so that the currents flowing through the lamps are also substantially equal;

a core having a first side and a second side; and a first bobbin and a second bobbin respectively disposed on the first side and the second side for winding around the first primary coil, the first secondary coil and the auxiliary coils.

22. The backlight module according to claim 21, wherein each of the auxiliary coils has one end coupled to one end of one of the lamps respectively, each of the lamps has the other end coupled to the first secondary coil respectively, and each of the auxiliary coils has the other end coupled to a grounding end respectively.

23. The backlight module according to claim 21, wherein each of the auxiliary coils has one end coupled to one end of one of the lamps respectively, each of the lamps has the other end coupled to one end of the first secondary coil respectively, each of the auxiliary coils has the other end coupled to a grounding end, and the first secondary coil has the other end coupled to the grounding end.

24. The backlight module according to claim 21, wherein the first primary coil winds around the first bobbin, and the first secondary coil and the auxiliary coils wind around the second bobbin.

25. The backlight module according to claim 24, wherein the secondary winding further comprises a second secondary coil winding around the second bobbin.

26. The backlight module according to claim 25, wherein the primary winding further comprises a second primary coil winding around the first bobbin.

27. The backlight module according to claim 21, wherein the first primary coil and the first secondary coil wind around the first bobbin, and the auxiliary coils wind around the second bobbin.

28. The backlight module according to claim 27, wherein the secondary winding further comprises a second secondary coil winding around the first bobbin.

29. The backlight module according to claim 28, wherein the primary winding further comprises a second primary coil winding around the first bobbin.

30. The backlight module according to claim 21, wherein the secondary winding further comprises a second secondary coil, the primary winding further comprises a second primary coil, the first primary coil and the first secondary coil wind around the first bobbin, the second primary coil and the second secondary coil wind around the second bobbin, and the auxiliary coils wind around the first bobbin and the second bobbin respectively.

31. A backlight module, comprising:

a plurality of lamps; and a driving circuit;

a transformer, comprising:

a primary winding, comprising:

a first primary coil coupled to the driving circuit;

a secondary winding, comprising:

a first secondary coil; and a plurality of auxiliary coils, wherein the lamps are coupled to corresponding auxiliary coils respectively, the lamps are coupled to the first secondary coil through the auxiliary coils respectively, and the turns of the auxiliary coils are substantially equal, so that the currents flowing through the lamps are also substantially equal;

a core having a first side and a second side; and a first bobbin and a second bobbin respectively disposed on the first side and the second side for winding around the first primary coil, the first secondary coil and the auxiliary coils.

32. The backlight module according to claim 31, wherein each of the auxiliary coils has one end coupled to the lamps respectively, and each of the auxiliary coils has the other end coupled to the first secondary coil respectively.

33. The backlight module according to claim 31, wherein the secondary winding further comprises a second secondary coil, each of the auxiliary coils has one end coupled to the lamps respectively, each of the auxiliary coils has the other end coupled to one end of the first secondary coil and one end of the second secondary coil respectively, and the other end of the first secondary coil and the other end of the second secondary coil are coupled to a grounding end.

34. The backlight module according to claim 31, wherein the first primary coil wind around the first bobbin, and the first secondary coil and the auxiliary coils wind around the second bobbin.

35. The backlight module according to claim 34, wherein the secondary winding further comprises a second secondary coil winding around the second bobbin.

36. The backlight module according to claim 35, wherein the primary winding further comprises a second primary coil winding around the first bobbin.

37. The backlight module according to claim 31, wherein the first primary coil and the first secondary coil wind around the first bobbin, the auxiliary coils wind around the second bobbin.

38. The backlight module according to claim 37, wherein the secondary winding further comprises a second secondary coil winding around the first bobbin.

39. The backlight module according to claim 38, wherein the primary winding further comprises a second primary coil winding around the first bobbin.

40. The backlight module according to claim 31, wherein the secondary winding further comprises a second secondary coil, the primary winding further comprises a second primary coil, the first primary coil and the first secondary coil wind around the first bobbin, the second primary coil and the second secondary coil wind around the second bobbin, and the auxiliary coils wind around the first bobbin and the second bobbin respectively.

* * * * *